US006063559A

United States Patent [19]

Uyttendaele et al.

[11] Patent Number: 6,063,559

[45] Date of Patent: May 16, 2000

[54] AMINO-TRIAZINE COMPOUNDS FOR (PHOTO)THERMOGRAPHIC MATERIALS

[75] Inventors: Carlo Uyttendaele, Mortsel; Ivan Hoogmartens, Wilrijk, both of Belgium

[73] Assignee: Agfa-Gevaert, Mortsel, Belgium

[21] Appl. No.: 09/135,628

[22] Filed: Aug. 17, 1998

Related U.S. Application Data

[60] Provisional application No. 60/069,216, Dec. 11, 1997.

[30] Foreign Application Priority Data

Sep. 17, 1997 [EP] European Pat. Off. ..... 97202871

[51] Int. Cl.[7] ..... G03C 1/498

[52] U.S. Cl. ..... 430/617; 430/523; 430/531; 430/607; 430/613; 430/614; 430/621; 430/623

[58] Field of Search ..... 430/619, 523, 430/617, 613, 614, 607, 621, 623, 531

[56] References Cited

U.S. PATENT DOCUMENTS 5,576,163 11/1996 Anderson et al. ..... 430/529
5,674,654 10/1997 Zumbulyadis et al. .

FOREIGN PATENT DOCUMENTS 2063500 6/1981 United Kingdom .

OTHER PUBLICATIONS

"Stabilizer Compound for Dye Enhanced Photothermographic Material" by Tan et al. Research Disclosure, vol. 169, No. 16979, May 1978, Havant GB, pp. 66–67, XP002063608.

*Primary Examiner*—Thorl Chea
*Attorney, Agent, or Firm*—Baker Botts L.L.P.

[57] ABSTRACT

A (photo)thermographic recording material according to the present invention comprising a thermosensitive element contains a substantially light-insensitive organic silver salt, a reducing agent therefor in thermal working relationship therewith and a binder (and optionally further including photosensitive silver halide), wherein the (photo) thermographic recording material is exclusive of polypyrrole/poly(styrene sulfonic acid) in an electrically-conductive layer and further contains a compound represented by formula (I) or a reaction product thereof with a polymer having active hydrogen atoms:

(I)

where $R^1$ and $R^3$ independently represent hydrogen, a hydroxyalkyl group, an alkoxyalkyl group, an alkyl group, a —(C=O)$R^5$ group or an alkenyl group; and $R^2$ and $R^4$ independently represent a hydroxyalkyl group, an alkoxyalkyl group, an alkyl group, a —(C=O)$R^5$ group or an alkenyl group; or $R^1$ and $R^2$ together and $R^3$ and $R^4$ together independently represent the atoms needed to close a carbocyclic or heterocyclic ring; $R^5$ represents an aryl, a substituted aryl, an alkyl or a substituted alkyl group; and Z represents the atoms needed to complete a 5 ring-atom or 6 ring-atom hetero-aromatic ring; and a production process therefor.

26 Claims, 1 Drawing Sheet

AMINO-TRIAZINE COMPOUNDS FOR (PHOTO)THERMOGRAPHIC MATERIALS

The application claims the benefit of U.S. Provisional Application Ser. No. 60/069,216 filed Dec. 11, 1997.

FIELD OF THE INVENTION

The present invention relates to photothermographic and substantially light-insensitive thermographic recording materials comprising a novel compound or or a reaction product thereof with a polymer having active hydrogen atoms.

BACKGROUND OF THE INVENTION

Thermal imaging or thermography is a recording process wherein images are generated by the use of thermal energy.

In thermography three approaches are known:

1. Direct thermal formation of a visible image pattern by image-wise heating of a recording material containing matter that by chemical or physical process changes colour or optical density.
2. Image-wise transfer of an ingredient necessary for the chemical or physical process bringing about changes in colour or optical density to a receptor element.
3. Thermal dye transfer printing wherein a visible image pattern is formed by transfer of a coloured species from an image-wise heated donor element onto a receptor element.

Thermographic materials of type 1 become photothermographic upon incorporating a photosensitive agent which after exposure to UV, visible or IR light is capable of catalyzing or participating in a thermographic process bringing about changes in colour or optical density.

Most of the "direct" thermographic recording materials are of the chemical type. On heating to a certain conversion temperature, an irreversible chemical reaction takes place and a coloured image is produced.

JN 02/00864 discloses a heat-developing photosensitive material comprising a heat-developing photosensitive component which contains at least a photosensitive silver halide, a dye donative material, a reducer and binder on a support and an image-receiving component which is piled with the photosensitive component at least on transferring of image. The developing photosensitive component and/or the image-receiving component contains (a) compound of formula (I):

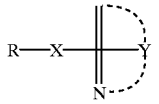

where Y=non-metallic atom group necessary to form a nitrogen-containing heterocyclic; X=S, sulphonyl, OR or quaternary N atom; R=substituent Among the embodiments (A), (B) and (C) of formula (I) given in the description are 1,3,5-triazine compounds and a specific compound according to embodiment (B), compound 9, is 2,4-bis (trimethylammonium)-6-decylamino-1,3,5-triazine-dichloride.

EP-A 831 365 discloses an imaging element for use in an image-forming process; the imaging element comprising a support, an image-forming layer; and a transparent electrically conductive layer comprising polypyrrole/poly(styrene sulfonic acid).

The standard teaching over thermographic materials based on a substantially light-insensitive organic silver salt and a reducing agent for the organic silver salt is that the organic silver salt is formed in an aqueous medium and is precipitated and dried before dispersion in an organic solvent medium from which the dispersion is coated. This production method is very inefficient as the organic silver salt after formation in water has to be separated and dried before dispersion in a solvent medium, is environmentally unsound as evaporation of solvent takes place during the coating process and it involves lengthy utilization of plant during the preparation of the organic silver salt dispersion and coating requires costly plant due to the need for solvent explosion prevention measures and solvent recovery to prevent solvent emission to the environment.

WO 94/16361 addressees this problem and discloses a multilayer heat-sensitive material which comprises: a colour-forming layer comprising: a colour-forming amount of finely divided, solid colourless noble metal or iron salt of an organic acid distributed in a carrier composition; a colour developing amount of a cyclic or aromatic organic reducing agent, which at thermal copy and printing temperatures is capable of a colour-forming reaction with the noble metal or iron salt; and an image-toning agent; characterized in that (a) the carrier composition comprises a substantially water-soluble polymeric carrier and a dispersing agent for the noble metal or iron salt and (b) the material comprises a protective overcoating layer for the colour-forming layer.

WO 95/12495 discloses a method of recording an image by image-wise heating a recording layer, the recording material comprising on the same side of a support, called the heat-sensitive side, (1) one or more layers comprising an imaging composition essentially consisting of (i) a substantially light-insensitive organic silver salt being in thermal working relationship with (ii) a reducing agent, and (2) at same side covering the imaging composition a protective layer, characterized in that the image-wise heating proceeds with a thermal head contacting the heat-sensitive side and through the protective layer mainly comprising a cured polymer or cured polymer composition e.g. hydrophilic polymers having active hydrogen atoms selected from the group of polyvinyl alcohol, partially hydrolyzed polyvinyl acetate and gelatin at least part of which has reacted with hardening agents selected from the group consisting of polyisocyanates, polyepoxides, aldehydes and hydrolysed tetraalkyl orthosilicates.

U.S. Pat. No. 5,661,101 discloses a recording material with, on a support, at least a coloring layer containing a first coloring component which is substantially colorless and a second coloring component which is substantially colorless and is colored by reacting with the first coloring component, and a protective layer provided on the coloring layer and having a pigment and a binder as main components, wherein at least the protective layer contains a polyvinyl alcohol resin having a syndiotacticity of greater than or equal to 55 molar % as diad indication and a saponification degree of greater than or equal to 85 molar %. Furthermore, the protective layer may contain, in addition to the polyvinyl alcohol resin, a cross-linking agent for cross-linking the polyvinyl alcohol resin e.g. epoxy compounds, blocked isocyanates, vinyl sulfone compounds, aldehyde compounds, methylol compounds, boric acid, carboxylic acid anhydrides, silane compounds, chelating compounds and halogenated compounds.

The inventors of the present invention found that prints made with thermographic materials produced from aqueous media, according to the teaching of WO 94/16361, exhibited poor archivability and poor light stability. Furthermore, thermographic materials with crosslinked protective layers coated from aqueous media according to the teaching of WO 95/12495, require the use of substantial quantities of water-miscible solvents, e.g. the use of hydrolyzed tetaalkyl orthosilicates, or involved products such as formaldehyde for which emission norms are extremely low. Furthermore, such thermographic recording materials exhibited poor archivability.

OBJECTS OF THE INVENTION

It is therefore an object of the present invention to provide thermographic recording materials coated from aqueous media whose prints exhibit high maximum density and low minimum density levels and improved archivability and/or improved light stability.

It is therefore an object of the present invention to provide photothermographic materials coated from aqueous media whose prints exhibit high maximum density and low minimum density levels and improved archivability and/or improved light stability.

It is therefore another object of the present invention to provide a protective layer for thermographic materials which enables reliable transport and does not cause image faults, while avoiding the use of organic solvents and the emission of noxious agents.

It is therefore another object of the present invention to provide a protective layer for photothermographic materials which enables reliable transport and does not cause image faults, while avoiding the use of organic solvents and the emission of noxious agents.

Further objects and advantages of the invention will become apparent from the description hereinafter.

SUMMARY OF THE INVENTION

It has been surprisingly found that the presence of compounds represented by formula (I) in thermographic and photothermographic recording materials coated from aqueous media substantially improves the archivability and/or the light stability of prints made with such materials. Furthermore, compounds represented by formula (I) have been found to be useful hardening agents for the protective layers of thermographic and photothermographic recording materials not requiring solvent during the coating process and not producing noxious emissions during the coating process.

A substantially light-insensitive thermographic material is provided according to the present invention comprising a thermosensitive element containing a substantially light-insensitive organic silver salt, a reducing agent therefor in thermal working relationship therewith and a binder, wherein the thermographic recording material is exclusive of polypyrrole/poly(styrene sulfonic acid) in an electrically-conductive layer and further contains a compound represented by formula (I) or a reaction product thereof with a polymer having active hydrogen atoms:

(I)

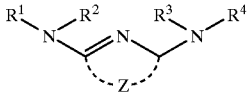

where $R^1$ and $R^3$ independently represent hydrogen, a hydroxyalkyl group, an alkoxyalkyl group, an alkyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; or $R^1$ and $R^2$ together and $R^3$ and $R^4$ together independently represent the atoms needed to close a carbocyclic or heterocyclic ring; $R^5$ represents an aryl or an alkyl group; and Z represents the atoms needed to complete a 5 ring-atom or 6 ring-atom hetero-aromatic ring.

A process for producing the above described thermographic recording material is also provided according to the present invention, comprising the steps of: preparing aqueous dispersions or solutions together containing the substantially light-insensitive organic silver salt, the organic reducing agent therefor, the binder and the compound represented by formula (I); coating the dispersions or solutions onto a support to form the one or more layers making up the thermosensitive element.

A photothermographic recording material is further provided according to the present invention comprising a photo-addressable thermally developable element containing a substantially light-insensitive organic silver salt, a reducing agent therefor in thermal working relationship therewith, photosensitive silver halide in catalytic association with the substantially light-insensitive organic silver salt and a binder, wherein the photo-addressable thermally developable element is exclusive of a dye-donative material and the photothermographic recording material is exclusive of polypyrrole/poly(styrene sulfonic acid) in an electrically-conductive layer and further contains a compound represented by formula (I) or a reaction product thereof with a polymer having active hydrogen atoms:

(I)

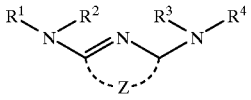

where $R^1$ and $R^3$ independently represent hydrogen, a hydroxyalkyl group, an alkoxyalkyl group, an alkyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; or $R^1$ and $R^2$ together and $R^3$ and $R^4$ together independently represent the atoms needed to close a carbocyclic or heterocyclic ring; $R^5$ represents an aryl or an alkyl group; and Z represents the atoms needed to complete a 5 ring-atom or 6 ring-atom hetero-aromatic ring.

Process for producing a photothermographic recording material, as described above, is still further provided according to the present invention comprising the steps of: preparing aqueous dispersions or solutions together containing the substantially light-insensitive organic silver salt, the organic reducing agent therefor, the photosensitive silver halide, the binder and the compound represented by formula (I); coating the dispersions or solutions onto a support to form the one or more layers making up the photo-addressable thermally developable element.

Preferred embodiments of the present invention are disclosed in the detailed description of the invention.

DETAILED DESCRIPTION OF THE INVENTION

The invention is described hereinafter by way of examples with reference to the accompanying figure wherein.

Aqueous

Figure 1:
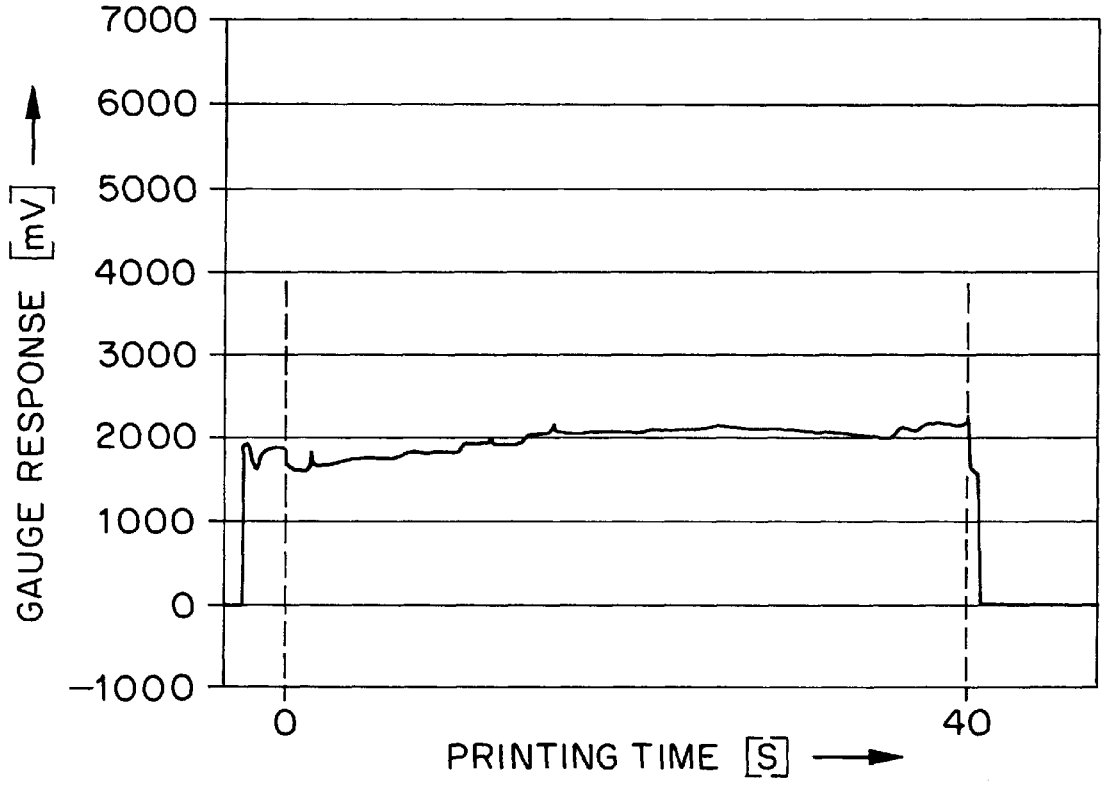
FIG. 1 shows a print-out of strain gauge response in millivolts as a function of printing time in seconds (=position on print with 11 blocks each printed at different electrical energies per dot), as a measure of the dynamical frictional coefficient upon the printing of the thermographic recording material of COMPARATIVE EXAMPLE 4.

The term aqueous for the purposes of the present invention includes mixtures of water with water-miscible organic solvents such as alcohols e.g. methanol, ethanol, 2-propanol, butanol, iso-amyl alcohol etc.; glycols e.g. ethylene glycol; glycerine; N-methyl pyrrolidone; methoxypropanol; and ketones e.g. 2-propanone and 2-butanone etc.

Substantially

By substantially light-insensitive is meant not intentionally light sensitive. By substantially solvent-free aqueous medium is meant that solvent, if present, is present in amounts below 10% by volume of the aqueous medium.

Compounds Represented by Formula (I)

The substituents represented by $R^1$, $R^2$, $R^3$, $R^4$, $R^5$ and Z of the compound represented by formula 1 may themselves be substituted. The compound represented by formula (I) is preferably exclusively present in the thermosensitive element of a thermographic recording material according to the present invention or in the photo-addressable thermally developable element of a photothermographic recording material according to the present invention.

Preferred compounds represented by formula (I) are selected from the group consisting of: 2,4-diamino-1,3,5-triazine compounds, 2,4,6-triamino-1,3,5-triazine compounds, 2,6-diaminopyridine compounds, 2,4-diamino-pyrimidine compounds, 2,4,6-triamino-pyrimidine compounds, 2,5-diaminopyrrole compounds and 2,5-diamino-oxazole compounds. Many 2,4-diamino-1,3,5-triazine compounds and 2,4,6-triamino-1,3,5-triazine compounds have been described in the literature: e.g. Smolin and Rapoport, The Chemistry of Heterocyclic Compounds, s-Triazines and Derivatives (1959), Interscience Publishers Inc., New York. Preferred 2,4-diamino-1,3,5-triazine compounds and 2,4,6-triamino-1,3,5-triazine compounds for use in the thermographic and photothermographic recording materials of the present invention are selected from the group of compounds consisting of: melamine compounds, ammeline compounds, melam compounds and guanamine compounds.

Preferred substituents for the 5-ring-atom and 6-ring atom hetero-aromatic ring are hydrogen, chlorine, fluorine, iodine, bromine or a hydroxy, alkoxy, aryloxy, mercapto, thioalkoxy, a —(C═O)$R^6$, aryl, alkyl or —$NR^1R^2$ group, or a linking group between two or more diamino-1,3,5-triazine groups; and $R^6$ represents hydrogen or an alkyl, aryl, aryloxy, alkoxy, amino or hydroxy group; wherein all these groups may be substituted.

Suitable compounds according to formula (I) for use according to the present invention are:

# highly methylated melamine resins, for example:
- CYMEL™ 300, CYMEL™ 301 and CYMEL™ 303 (from DYNO-CYTEC Industries);
- CYMEL™ 350 (from DYNO-CYTEC Industries): hexamethoxymethyl-melamine, a methylated melamine-formaldehyde compound;
- DYNOMIN™ MM-100 (from DYNO-CYTEC Industries);
- MAPRENAL™ VMF3921W (from HOECHST as a 85% aqueous solution);
- MAPRENAL™ MF920 (from HOECHST as a 76% aqueous solution).

# methylated high imino melamine resins, for example:
- CYMEL™ 323, CYMEL™ 325 and CYMEL™ 327 (from DYNO-CYTEC Industries);
- CYMELM™ 328 (from DYNO-CYTEC Industries as a 85% aqueous solution): methoxymethyl-melamine;

# partially methylated melamine resins, for example:
- CYMEL™ 370 (from DYNO-CYTEC Industries);
- CYMELT™ 373 (from DYNO-CYTEC Industries as a 85% aqueous solution);
- CYMEL™ 385 (from DYNO-CYTEC Industries as a 79% aqueous solution): methoxymethyl methylol melamine, a methylated melamine-formaldehyde compound;
- DYNOMIN™ MM-9-IIp and DYNOMIN™ MN-75-E (from DYNO-CYTEC Industries);

# highly alkylated melamine resins, for example:
- CYMEL™ 1116, CYMEL™ 1130, CYMEL™ 1133, CYMEL™ 1141, CYMEL™ 1161 and CYMEL™ 1168 (from DYNO-CYTEC Industries);

a partially alkylated melamine resin:
- MADURITE™ MW815 (from HOECHST as a 75% solution);

# high imino melamine resins, for example:
- CYMEL™ 202 (from DYNO-CYTEC Industries);
- CYMEL™ 254 (from DYNO-CYTEC Industries);

# highly alkylated benzoguanamine resins, for example:
- CYMEL™ 1123 and CYMELT™ 1125 (from DYNO-CYTEC Industries);

a high solids, partially methylated melamine formaldehyde crosslinking resin solution in water:
- RESIMENE™ AQ7550 (from MONSANTO as a 78% aqueous solution);

tris-N-methoxymethyl-tris-N-hydroxymethyl-melamine;
# polymethylolmelamines, for example: trimethylolmelamine; hexamethylolmelamine; 2-amino-4,6-bis (hydroxymethylamino)-1,3,5-triazine;
poly-N-methoxymethyl-melamines, for example: hexakis-N-methoxymethyl-melamine;
tris-N-ethoxymethyl-tris-N-hydroxymethyl-melamine;
poly-N-ethoxymethyl-melamines, for example: hexakis-N-ethoxymethyl-melamine;
poly-N-propoxymethyl-melamines, for example: hexakis-N-n-propoxymethyl-melamine; hexakis-N-isopropoxymethyl-melamine etc.;
tris-N-n-propoxymethyl-tris-N-hydroxymethyl-melamine;
tris-N-isopropoxymethyl-tris-N-hydroxymethyl-melamine;
poly-butoxymethyl-melamines, for example: hexakis-N-n-butoxymethyl-melamine; hexakis-N-isobutoxymethyl-melamine; hexakis-N-t-butoxymethyl-melamine etc.;
tris-N-N-n-butoxymethyl-tris-N-hydroxymethyl-melamine;
tris-N-isobutoxymethyl-tris-N-hydroxymethyl-melamine;
tris-N-t-butoxymethyl-tris-N-hydroxymethyl-melamine;
bis-[N-N-bis(methoxymethyl)amino][N-(methoxymethyl) amino]-1,3,5-triazine;
bis-[N-(methoxymethyl)amino]-[N,N-bis (methoxymethyl)amino]-1,3,5-triazine;
2,4-diamino-6-phenylamino-1,3,5-triazine;
2,4-diamino-6-benzylamino-1,3,5-triazine;
2,4-diamino-6-allylamino-1,3,5-triazine;
2,4-diamino-6-n-propylamino-1,3,5-triazine;
2,4-diamino-6-methylamino-1,3,5-triazine;
2,4-diamino-6-morpholino-1,3,5-triazine;
# ammeline compounds, for example:

poly-hydroxymethyl-ammelines; poly-methoxymethyl-ammelines, poly-ethoxymethyl-ammelines,poly-butoxymethyl-ammelines;

# melam compounds, for example:

poly-hydroxymethyl-melams, poly-methoxymethyl-melams, poly-ethoxymethyl-melams, poly-butoxymethyl-melams;

# guanamine compounds, for example:

poly-hydroxymethyl-acetoguanamines, poly-methoxymethyl-acetoguanamines; poly-ethoxymethyl-acetoguanamines; poly-butoxymethyl-acetoguanamines; poly-hydroxymethyl-butyro-guanamines, poly-methoxymethyl-butyroguanamines, poly-ethoxymethyl-butyroguanamines, poly-butoxymethyl-butyro-guanamines, poly-hydroxymethyl-caprinoguanamines, poly-methoxymethyl-caprinoguanamines; poly-ethoxymethyl-caprino-guanamines, poly-butoxymethyl-caprinoguanamines, poly-hydroxymethyl-benzoguanamines, poly-methoxymethyl-benzo-guanamines, poly-ethoxymethyl-benzoguanamines, poly-butoxy-methyl-benzoguanamines;

and etherification products of melamine, ammeline, melam, acetoguanamine, butyroguanamine, caprinoguanamine, benzoguanamine with polyhydric alcohols, for example ethylene glycol, glycerol, pentaerythritol etc.

Thermosensitive Element

According to the present invention, a thermographic recording material is provided comprising a thermosensitive element including a substantially light-insensitive organic silver salt, an organic reducing agent therefor in thermal working relationship therewith and a binder. The thermosensitive element may further comprise photosensitive silver halide in catalytic association with the organic silver salt, whereupon it becomes a photo-addressable thermally developable element and the material a photothermographic material.

The thermosensitive or photo-addressable thermally developable element may comprise a layer system in which the ingredients are dispersed in different layers, with the proviso that the substantially light-insensitive organic silver salt and the organic reducing agent are in thermal working relationship with one another i.e. during the thermal development process the organic reducing agent must be present in such a way that it is able to diffuse to the substantially light-insensitive organic silver salt particles so that reduction of the organic silver salt can take place. The thickness of the thermosensitive or photo-addressable thermally developable element is preferably in the range of 1 to 50 $\mu$m.

Light-insensitive Organic Silver Salts

Preferred substantially light-insensitive organic silver salts for use in the photothermographic and thermographic recording materials of the present invention are silver salts of organic carboxylic acids and in particular silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image. Combinations of different organic silver salts may be used in the thermographic recording materials according to the present invention.

A process for producing a suspension of particles containing a substantially light-insensitive organic silver salt is disclosed in EP-A 754 969. The weight ratio of binder to organic silver salt weight used according to the present invention is preferably in the range of 0.2 to 6.

Organic Reducing Agents

Suitable organic reducing agents for the reduction of the substantially light-insensitive organic silver salts are organic compounds containing at least one active hydrogen atom linked to O, N or C, such as is the case with: catechol; hydroquinone; aminophenols; METOL™; p-phenylenediamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Polyphenols such as the bisphenols used in the previous 3M DRY SILVER™ materials and current IMATION DRY SILVER™ materials, sulfonamide phenols such as used in the KODAK DACOMATIC™ materials, and naphthols are particularly preferred for photothermographic materials on the basis of silver halide/organic silver salt/reducing agent.

Auxiliary Reducing Gents

The above mentioned reducing agents, regarded as primary or main reducing agents, may be used in conjunction with so-called auxiliary reducing agents. Such auxiliary reducing agents are e.g. sterically hindered phenols, such as described in U.S. Pat. No. 4,001,026; bisphenols, e.g. of the type described in U.S. Pat. No. 3,547,648; or sulfonamidophenols as described in Research Disclosure 17842 published in February 1979, U.S. Pat. No. 4,360,581, U.S. Pat. No. 4,782,004 and in EP-A 423 891. The auxiliary reducing agents may be present in the imaging layer or in a polymeric binder layer in thermal working relationship thereto.

Other auxiliary reducing agents that may be used in conjunction with the above mentioned primary reducing agents are hydrazides such as disclosed in EP-A 762 196, sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; 2-substituted malondialdehyde compounds as disclosed in U.S. Pat. No. 5,654,130; and organic reducing metal salts, e.g. stannous stearate described in U.S. Pat. Nos. 3,460,946 and 3,547,648.

Binders

Film-forming binders useful in the thermographic and photothermographic materials of the present invention may be solvent soluble or solvent dispersible or may be water soluble or water dispersible.

Film-forming binders suitable for materials coated from solvent dispersions or solutions can be all kinds of natural, modified natural or synthetic resins or mixtures of such resins, wherein the organic silver salt can be dispersed homogeneously or dissolved: e.g. polyesters, polyurethanes, polycarbonates, polymers derived from (α,β-ethylenically unsaturated compounds such as after-chlorinated polyvinyl chloride, partially hydrolyzed polyvinyl acetate, polyvinyl alcohol, polyvinyl acetals, preferably polyvinyl butyral, and homopolymers and copolymers produced using monomers selected from the group consisting of: vinyl chloride, vinylidene chloride, acrylonitrile, acrylamides, methacrylamides; methacrylates, acrylates, methacrylic acid, acrylic acid, vinyl esters, styrenes, dienes and alkenes; or mixtures thereof.

Suitable water-soluble film-forming binders for use in thermographic and photothermographic materials according to the present invention are: polyvinyl alcohol, polyacrylamide, polymethacylamide, polyacrylic acid, polymethacrylic acid, polyvinylpyrrolidone, polyethyleneglycol, proteinaceous binders such as gelatin, modified gelatins such as phthaloyl gelatin, polysaccharides, such as starch, gum arabic and dextran and water-soluble cellulose derivatives. A preferred water-soluble binder for use in the thermographic and photothermographic recording materials of the present invention is gelatin.

Suitable water-dispersible binders for use in the thermographic and photothermographic materials of the present invention may be any water-insoluble polymer. Preferred water-dispersible binders for use in the thermographic and photothermographic recording materials of the present invention are polymer latexes. Suitable polymer latexes for use according to the present invention are the CYDROTHANE™ polyurethane dispersions from CYTEC-DYNO Industries, which are fully reacted, high molecular weight polyurethane-polyurea polymers dispersed in water by neutralizing the ionic groups in the prepolymer backbone, for example polymer latex numbers 1 to 7 given in table 1 below:

TABLE 1

| polymer latex nr | CYDROTHANE ™ | polymer latex nr. | CYDROTHANE ™ | polymer latex nr. | CYDROTHANE ™ |
|---|---|---|---|---|---|
| 1 | HP-1035 | 4 | HP-4033 | 6 | HP-5135 |
| 2 | HP-2035 | 5 | HP-5035 | 7 | HP-6035 |
| 3 | HP-3130 | | | | |

Other polymer latexes suitable for use in the thermographic and photothermographic recording materials of the present invention are chain polymerized, for example those given in table 2 below:

TABLE 2

| polymer latex number | B [% by wt.] | IP [% by wt.] | BA [% by wt.] | S [% by wt.] | MMA [% by wt.] | IA [% by wt.] | MAA [% by wt.] | AA [% by wt.] |
|---|---|---|---|---|---|---|---|---|
| 8 | 47.5 | — | — | — | 47.5 | 5 | — | — |
| 9 | 49 | — | — | — | 49 | 2 | — | — |

where: B = butadiene; MMA = methyl methacylate; IA = itaconic acid.

According to the present invention, mixtures of polymers may be used, for example mixtures of water-soluble polymers, mixtures of water-dispersible polymers, or mixtures of water-soluble and water-dispersible polymers.

Protective Layer

In a preferred embodiment of the thermographic recording material of the present invention, the thermosensitive element is provided with a protective layer and the protective layer contains the compound represented by formula (I) substantially as a reaction product with a polymer having active hydrogen atoms.

In a further preferred embodiment of the photothermographic recording material of the present invention, the photo-addressable thermally developable element is provided with a protective layer and the protective layer contains the compound represented by formula (I) substantially as a reaction product with a polymer having active hydrogen atoms.

By a protective layer containing a compound represented by formula (I) substantially as a reaction product with a polymer having active hydrogen atoms is meant that at least 90% of the compound according to formula (I) present in the protective layer is present as a reaction product with the polymer having active hydrogen atoms. The quantity of the compound represented by formula (I) in the protective layer used in the present invention is preferably 1 to 80% by weight with respect to the polymer having active hydrogen atoms, particularly preferably 2 to 50% by weight with respect to the polymer having active hydrogen atoms and especially preferably 5 to 30% by weight with respect to the polymer having active hydrogen atoms.

The reaction product between a compound represented by formula (I) and a polymer having active hydrogen atoms is a crosslinked layer produced by acid-catalyzed reaction of the active hydrogen atoms of the polymer with the compound represented by formula (I). Suitable acid catalysts include sulfonic acids e.g. methanesulfonic acid, para-toluenesulfonic acid, dinonylnaphthalenedisulfonic acid, dodecylbenzenesulfonic acid and dinonylnaphthalenesulfonic acid.

Polymers having active hydrogen atoms containing hydroxy groups are preferred. Suitable polymers having active hydrogen atoms for use in the present invention include: polyvinyl alcohol; gelatin and gelatin derivatives; dextran and dextran derivatives; polysaccharoses; acrylic resins with methylol-groups; methacrylic resins with methylol-groups; polyacrylamides; polymethacrylamides; hydroxycelluloses and hydroxyalkylcelluloses, with polyvinyl alcohol being particularly preferred.

A protective layer may also be provided for the thermosensitive and photo-addressable thermally developable elements in which the compound represented by formula (I) is exclusively present in the thermosensitive and photo-addressable thermally developable elements respectively.

In general a protective layer protects the thermosensitive element and photo-addressable thermally developable element from atmospheric humidity and from surface damage by scratching etc. and prevents direct contact of printheads or heat sources with the recording layers. Protective layers for thermosensitive and photo-addressable thermally developable elements which come into contact with and have to be transported past a heat source under pressure, have to exhibit resistance to local deformation and good slipping characteristics during transport past the heat source during heating.

The protective layer may contain one or more binders which may be hydrophilic or hydrophobic. Suitable hydrophilic binders include: polyvinyl alcohol, gelatin and gelatin derivatives and other water-soluble polymers and polymer latexes.

The protective layer may also contain finely divided inorganic particles (i.e. average particle size of less than 1 μm) which modify the mechanical properties of the layer. Suitable finely divided inorganic particles include: colloidal silica, kieselsol, Boehmite and aluminium oxide, with colloidal silica being particularly preferred.

The protective layer may further contain a dissolved lubricating material and/or particulate material, e.g. talc particles, optionally protruding therefrom. Examples of suitable lubricating materials are a surface active agent, a liquid lubricant, a solid lubricant or mixtures thereof, which may be used with or without a polymeric binder. Suitable slipping layer compositions are described, for example, in U.S. Pat. No. 5,587,350, U.S. Pat. No. 5,536,696, U.S. Pat. No. 5,547,914, WO 95/12495, EP-A 775 592 and EP-A 775 595.

Thermal Solvents

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in a solid state in the recording layer at temperatures below 50° C., but upon heating becomes a plasticizer for the recording layer and/or a liquid solvent for at least one of the redox-reactants.

Toning Agents

In order to obtain a neutral black image tone in the higher densities and neutral grey in the lower densities, thermographic and photothermographic recording materials according to the present invention may contain one or more toning agents. The toning agents should be in thermal working relationship with the substantially light-insensitive organic silver salt and reducing agents during thermal processing. Any known toning agent from thermography or photothermography may be used. Suitable toning agents are the phthalimides and phthalazinones within the scope of the formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type described in GB-P 1,439,478, U.S. Pat. No. 3,951,660 and U.S. Pat. No. 5,599,647.

Surfactants and Dispersants

The thermographic and photothermographic recording materials of the present invention may contain one or more surfactants, which may be anionic, non-ionic or cationic surfactants and/or one or more dispersants. Examples of suitable surfactants are:

Surfactant Nr. 1=HOSTAPAL™ B, a sodium trisalkylphenyl-poly-ethyleneglycol(EO 7-8)sulphate from HOECHST;

Surfactant Nr. 2=MERSOLAT™ H80, a sodium hexadecylsulfonate from BAYER;

Surfactant Nr. 3=ULTRAVON™ W, a sodium arylsulfonate from CIBA-GEIGY;

Surfactant Nr. 4=TERGITOL™ 4, a sodium 1-(2'-ethylbutyl)-4-ethylhexylsulphate;

Surfactant Nr. 5=MARLON™ A-396, a sodium dodecylphenylsulfonate from HÜLS;

Surfactant Nr. 6=HOSTAPAL™ W, a nonylphenylpolyethylene-glycol from HOECHST;

Surfactant Nr. 7=AKYPO™ OP 80, supplied by CHEMY as an 80% concentrate of an octyl-phenyl-oxy-polyethylene-glycol(EO 8)acetic acid;

Surfactant Nr. 8=HOSTAPAL™ BV, a sodium trisalkylphenyl-poly-ethyleneglycol(EO 7-8)sulphate from HOECHST;

Surfactant Nr. 9=hexadecyl-dimethylammonium acetic acid.

Suitable dispersants are natural polymeric substances, synthetic polymeric substances and finely divided powders. Examples of fine powder dispersants are finely divided non-metallic inorganic powders such as silica.

Stabilizers and Antifoggants

In order to obtain improved shelf-life and reduced fogging, stabilizers and antifoggants may be incorporated into the thermographic and photothermographic materials of the present invention.

Other Ingredients

In addition to the ingredients the thermographic and photothermographic material may contain other additives such as free fatty acids, silicone oil, ultraviolet light absorbing compounds, white light reflecting and/or ultraviolet radiation reflecting pigments, silica, and/or optical brightening agents.

Support

The support for the thermographic and photothermographic materials according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the heat-sensitive recording layer coated thereon. The support may be made of an opacified resin composition.

Photosensitive Silver Halide

The photothermographic material of the present invention comprises photosensitive silver halide in catalytic association with the substantially light-insensitive organic silver salt. The photosensitive silver halide used in the present invention may be employed in a range of 0.1 to 100 mole percent; preferably, from 0.2 to 80 mole percent; particularly preferably from 0.3 to 50 mole percent; especially preferably from 0.5 to 35 mole %; and especially from 1 to 12 mole % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof.

Spectral Sensitizer

The photo-addressable thermally developable element of the photothermographic material, according to the present invention, may contain a spectral sensitizer for the photosensitive silver halide, optionally together with a supersensitizer. The photosensitive silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer.

Coating

The coating of any layer of the thermographic and photothermographic recording materials of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA.

Thermographic Printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy via the Joule effect into heat, which is transferred to the surface of the thermographic material, wherein the chemical reaction resulting in the development of a black and white image takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly or from an intermediary storage means.

Activation of the heating elements can be power-modulated or pulse-length modulated at constant power.

EP-A 654 355 describes a method for making an image by image-wise heating by means of a thermal head having energizable heating elements, wherein the activation of the heating elements is executed duty cycled pulsewise. When used in thermographic recording operating with thermal printheads the thermographic materials are not suitable for reproducing images with fairly large number of grey levels as is required for continuous tone reproduction. EP-A 622 217 discloses a method for making an image using a direct thermal imaging element producing improvements in continuous tone reproduction.

Image-wise heating of the thermographic material can also be carried out using an electrically resistive ribbon incorporated into the material. Image- or pattern-wise heating of the thermographic material may also proceed by means of pixel-wise modulated ultra-sound, using e.g. an ultrasonic pixel printer as described e.g. in U.S. Pat. No. 4,908,631.

Recording Process for Photothermographic Recording Materials

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating with for example a heated roller or a thermal head, radiative heating, microwave heating etc.

Industrial Applications

Thermographic and photothermographic materials according to the present invention may be used for both the production of transparencies, for example in the medical diagnostic field in which black-imaged transparencies are widely used in inspection techniques operating with a light box, and reflection type prints, for example in the graphics hard copy field. For such applications the support will be transparent or opaque, i.e. having a white light reflecting aspect. Should a transparent base be used, the base may be colourless or coloured, e.g. with a blue colour for medical diagnostic applications.

The following INVENTION EXAMPLES and COMPARATIVE EXAMPLES illustrate the present invention. The percentages and ratios used in the examples are by weight unless otherwise indicated. The following ingredients used in INVENTION EXAMPLES and COMPARATIVE EXAMPLES are indicated by the following codes:

i) subbing layer ingredients:

R 10985=a calcium-containing gelatin from ROUSSELOT;

KIESELSOL 100F=36% aqueous dispersion of colloidal silica (BAYER);

KIESELSOL 300F=30% aqueous dispersion of colloidal silica (BAYER);

PMMA=a 20% aqueous dispersion of polymethylmethacrylate particles 2 μm in diameter ii) thermosensitive element ingredients:

K7598=Type 7598, a calcium-free gelatin from AGFA-GEVAERT GELATINEFABRIEK vorm. KOEPFF & SÖHNE;

GEL01=a calcium-free gelatin;

AgBeh=silver behenate;

B79=BUTVAR™ B79, a polyvinyl butyral from MONSANTO;

R01=catechol;

R02=ethyl 3,4-dihydroxybenzoate;

S01=adipic acid;

S02=tetrachlorophthalic anhydride

S03=benzotriazole

T01=benzo[e][1,3]oxazine-2,4-dione;

T02=7-(ethylcarbonato)benzo[e][1,3]oxazine-2,4-dione;

BAYSILON™ MA=a silicone oil, from BAYER AG;

iii) protective layer ingredients:

MOWIOL™ 3-98=a polyvinyl alcohol from HOECHST;

POLYVIOL™ WX 48 20=a polyvinyl alcohol, from WACKER CHEMIE; purified polyvinyl alcohol=Polyviol™ WX 48 20 purified by methanol/water extraction (75/25 by volume);

GEL01=a calcium-free gelatin;

NATROSOL 250LR=a binder with active hydrogen atoms from HERCULES;

DEXTRAAN T70=a binder with active hydrogen atoms from PHARMACOSMOS;

CULMINAL M42=a binder with active hydrogen atoms from HENKEL;

CYANAMERE P26=a binder with active hydrogen atoms from CYTEC;

PVP K-60=a, polyvinylpyrrolidone, from ISP;

PRIMAL™ HA 16=a 45.5% solids acrylic latex from ROHM & HAAS;

SYLOID™ 72=a porous silica, from GRACE;

MICROACE™ TYPE P3=an Indian talc from NIPPON TALC;

STEAMIC™OOS=a talc from TALC DE LUZENAC;

SERVOXYL™ VPAZ 100=a mixture of monolauryl and dilauryl phosphate, from SERVO DELDEN B.V.;

SERVOXYL™ VPDZ 3/100=a mono[isotridecyl polyglycolether (3 EO)] phosphate, from SERVO DELDEN B.V.;

RILANIT™ GMS=a glycerine monotallow acid ester, from HENKEL AG;

LEVASIL™ VP AC 4055=a 15% aqueous dispersion of colloidal silica with acid groups substantially neutralized with sodium ions and a specific surface area of 500 $m^2/g$, from BAYER AG;

ammonium colloidal $SiO_2$=produced by converting LEVASIL™ VP AC 4055 with ion exchange resins first to its acid form and then into its ammonium form

COMPARATIVE EXAMPLE 1 AND INVENTION EXAMPLES 1 & 2

Subbed Polyethylene Terephthalate Support

A 0.34 mm thick polyethylene terephthalate sheet was first coated to a wet thickness of 7 μm with a composition which after drying and longitudinal and transverse stretching produced a 175 μm thick support coated with a sub-layer with the composition:

# terpolymer latex of vinylidene chloride/methylacrylate/itaconic acid (88/10/2): 162 mg/m$^2$
# colloidal silica (Kieselsol™ 100F from BAYER): 38 mg/m$^2$
# alkyl sulfonate surfactant (Surfactant Nr. 2): 0.6 mg/m$^2$
# aryl sulfonate surfactant (Surfactant Nr. 3): 4 mg/m$^2$ and then coated with a composition which after drying at 130° C. produced a second sub-layer with the following composition:

# gelatin (R 10985): 380 mg/m$^2$
# colloidal silica (Kieselsolm™ 300F): 341 mg/m$^2$
PMMA: 1 mg/$^2$
# an alkylpolyethylene glycol (Surfactant Nr. 6) 7 mg/m$^2$
# aryl sulfonate surfactant (Surfactant Nr. 3): 13 mg/m$^2$
4-chloro-3-methylphenol: 10 mg/m$^2$
1,2,6-trihydroxyhexane: 25 mg/m$^2$ these two sub-layers together forming the subbing layer of the polyethylene terephthalate support.

Preparation of a Silver Behenate Dispersion 1500 g of a 10% solution of Surfactant Nr. 5 were added with stirring to 2000 g of deionized water followed by 1500 g of silver behenate powder. After stirring for a further 30 minutes with a HOMOREX™ stirrer, the resulting silver behenate dispersion was stored for 24 hours in a refrigerator to allow the foam to dissipate. The dispersion was then stirred for 15 minutes with an ULTRA-TURRAX™ stirrer and then passed four times through a MICROFLUIDICS™ microfluidizer at a pressure of 400 bar to obtain the final aqueous dispersion of silver behenate consisting of 30% silver behenate and 3% of Surfactant Nr. 5.

Preparation of the Silver Behenate Emulsion Layers

The coating dispersion was prepared by adding with stirring to 26.25 g of a 17.6% aqueous solution of K7598 at 40° C.: 17.5 g of the aqueous silver behenate dispersion, deionized water (see table 3 for the quantities for the particular recording materials), a melamine compound (see table 3 for compound used and quantity used for the particular recording material), 2 g of a 9.4% solution of Surfactant Nr. 3 and ethanol (for quantity see table 3).

TABLE 3

| | | compound according to formula (I) | | | 9.4% | |
|---|---|---|---|---|---|---|
| | quantity of water [g] | type | non-volatiles [%] | quantity [g] | solution of Surfanctant Nr 3 [g] | quantity of ethanol [g] |
| Comparative example nr. | | | | | | |
| 1 | 4.25 | — | — | — | 2 | — |
| Invention example nr. | | | | | | |
| 1 | 2.23 | CYMEL 385 | 78 | 2.03 | 2 | — |
| 2 | 2.40 | CYMEL 328 | 85 | 1.86 | 2 | — |

The resulting emulsions for COMPARATIVE EXAMPLE 1 and INVENTION EXAMPLES 1 & 2 were then coated onto the subbed support and dried for 10 minutes at 50° C., producing a silver behenate coverage of approximately 3.85 g/m$^2$.

Overcoating With Reducing Agent-containing Layer

The silver behenate emulsion layers were overcoated with a solution containing 2.64 g of K7598, 0.65 g of R01 dissolved in 61.05 g of deionized water to which 0.3 g of a 1.4% solution of Surfactant Nr. 4 had been added and dried producing a R01 coating weight of 0.65 g/m$^2$.

Thermographic Printing

During printing of the recording materials of COMPARATIVE EXAMPLE 1 and INVENTION EXAMPLES 1 & 2 the print head was separated from the imaging layer by a thin intermediate material contacted with a slipping layer of a separable 5 $\mu$m thick polyethylene terephthalate ribbon coated successively with a subbing layer, heat-resistant layer and the slipping layer (anti-friction layer) giving a ribbon with a total thickness of 6 $\mu$n.

The printer was equipped with a thin film thermal head with a resolution of 300 dpi and was operated with a line time of 19 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the thermographic materials of COMPARATIVE EXAMPLE 1 and INVENTION EXAMPLES 1.& 2.

Image Evaluation

The maximum densities, $D_{max}$, and minimum densities $D_{min}$, of the prints were measured through a blue filter with a MACBETH™ TR924 densitometer in the grey scale step corresponding to data levels of 255 and 0 respectively and are given in table 4.

Archivability Test

The achivability of prints made with the thermographic materials of COMPARATIVE EXAMPLE 1 and INVENTION EXAMPLES 1 & 2 was evaluated on the basis of the observed changes in minimum density, $\Delta D_{min}$, upon heating the prints at 35° C. in a relative humidity (RH) of 80% for 3 days in the dark. The results are given in table 4.

Light Box Test

The stability of the image background of the prints made with the thermographic materials of COMPARATIVE EXAMPLE 1 and INVENTION EXAMPLES 1 & 2 was evaluated on the basis of the change in minimum (background) density measured through a blue filter using a MACEETH™ TR924 densitometer, $\Delta D_{min}$, upon exposure on top of the white PVC window of a specially constructed light-box placed for 3 days in a VOTSCH conditioning cupboard set at 30° C. and a relative humidity (RH) of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 PLANILUX™ TLD 36W/54 fluorescent lamps 27 mm in diameter mounted length-wise equidistant from the two sides, with the lamps positioned equidistantly to one another and the sides over the whole width of the light-box and with the tops of the fluorescent tubes 30 mm below the bottom of the white PVC plate and 35 mm below the materials being tested. The results are summarized in table 4.

The thermographic recording materials of INVENTION EXAMPLES 1 & 2 with the compounds according to formula (I) CYMEL™385 and CYMEL™328, according to the present invention, exhibited superior archivability [i.e. a lower $\Delta D_{min}$ (blue)] to the thermographic recording material in the absence of a compound according to formula (I)]. The thermographic recording material of INVENTION EXAMPLE 1 also exhibited superior light box stability [i.e. a lower $\Delta D_{min}$ (blue)] to the thermographic recording material of COMPARATIVE EXAMPLE 1.

COMPARATIVE EXAMPLE 2 AND INVENTION EXAMPLE 3

The aqueous silver behenate dispersion was prepared as described for COMPARATIVE EXAMPLE 1 and INVENTION EXAMPLES 1 & 2. The silver behenate emulsion layers of the recording materials of COMPARATIVE EXAMPLE 2 and INVENTION EXAMPLE 3 were prepared by adding with stirring to 15.67 g of a 33.5% dispersion of polymer latex nr. 5: 17.5 g of the aqueous silver behenate dispersion, then deionized water (see table 5 for the quantities for the particular recording materials), a melamine compound, if applicable, (see table 5 for the compound and quantity used for the particular recording material), 2 g of a 9.4% solution of Surfactant Nr. 3 and 3 g of ethanol.

TABLE 4

| | | AgBeh coverage [g/m²] | binder | compound according to formula (I) | Fresh $D_{max}/D_{min}$ (blue) | Archivability $\Delta D_{min}$ (blue) after 3d at 35° C./80% RH | Light box $\Delta d_{min}$ (blue) after 3d at 30° C./85% RH |
|---|---|---|---|---|---|---|---|
| Comparative Example number | 1 | 3.58 | K7598 | — | 4.73/0.04 | +0.36 | +0.13 |
| Invention Example number | 1 | 3.79 | K7598 | CYMEL ™ 385 | 5.14/0.04 | +0.22 | +0.06 |
| | 2 | 4.21 | K7598 | CYMEL ™ 328 | 5.20/0.05 | +0.23 | +0.22 |

TABLE 5

| | | quantity of | compound according to formula (I) | | | 9.4% solution of | quantity of |
|---|---|---|---|---|---|---|---|
| | | water [g] | type | non-volatiles [%] | quantity [g] | Surfactant Nr 3 [g] | ethanol [g] |
| Comparative example number | 2 | 5.48 | — | — | — | 2 | 3 |
| Invention example number | 3 | 3.45 | CYMEL 385 | 78 | 2.03 | 2 | 3 |

The resulting emulsions for COMPARATIVE EXAMPLE 2 and INVENTION EXAMPLES 3 were then coated onto a subbed polyethylene terephthalate support and then dried for 10 minutes at 50° C., producing a silver behenate coverage of approximately 4.50 g/m$^2$.

The emulsion layers were then overcoated with a solution of R01 in aqueous gelatin as described for COMPARATIVE EXAMPLE 1 and INVENTION EXAMPLES 1 & 2.

Thermographic Evaluation

Thermographic evaluation of the recording materials of COMPARATIVE EXAMPLE 2 and INVENTION EXAMPLE 3 was carried out as described for COMPARATIVE EXAMPLE 1 and INVENTION EXAMPLES 1 & 2. The results are summarized in table 6.

TABLE 6

| | | AgBeh coverage [g/m$^2$] | polymer latex number | compound according to formula (I) | Fresh $D_{max}/D_{min}$ (blue) | Archivability $\Delta d_{min}$ (blue) after 3d at 35° C./80% RH | Light box $\Delta d_{min}$ (blue) after 3d at 30° C./85% RH |
|---|---|---|---|---|---|---|---|
| Comparative Example number | 2 | 4.47 | 5 | — | 4.51/0.05 | +0.17 | +0.29 |
| Invention Example number | 3 | 4.50 | 5 | CYMEL ™ 385 | 3.76/0.05 | +0.10 | +0.01 |

The thermographic recording material of INVENTION EXAMPLE 3 with CYMEL™385, a compound according to formula (I), according to the present invention, exhibited superior archivability [i.e. a lower $\Delta D_{min}$ (blue)] and superior light box stability [i.e. a lower $\Delta D_{min}$ (blue)] to the thermographic recording material of COMPARATIVE EXAMPLE 2, in the absence of a compound according to formula (I).

COMPARATIVE EXAMPLE 3 AND INVENTION EXAMPLE 4

The aqueous silver behenate dispersion was prepared as described for COMPARATIVE EXAMPLE 1 and INVENTION EXAMPLES 1 & 2. The silver behenate emulsion layers of the recording materials of COMPARATIVE EXAMPLE 3 and INVENTION EXAMPLE 4 were prepared by adding with stirring to 17.5 g of a 30% dispersion of polymer latex nr. 8: 17.5 g of the aqueous silver behenate dispersion, then deionized water (see table 7 for the quantities for the particular recording materials), a melamine compound, if applicable, (see table 7 for compound and quantity used for the particular recording material) and 2 g of a 9.4% solution of Surfactant Nr. 3.

TABLE 7

| | | quantity of water [g] | compound according to formula (I) type | non-volatiles [%] | quantity [g] | 9.4% solution of Surfactant Nr 3 [g] | quantity of ethanol [g] |
|---|---|---|---|---|---|---|---|
| Comparative Example number | 3 | 13.00 | — | — | — | 2 | — |
| Invention Example number | 4 | 10.98 | CYMEL ™ 385 | 78 | 2.03 | 2 | — |

The resulting emulsions for COMPARATIVE EXAMPLE 3 and INVENTION EXAMPLE 4 were then coated onto a 175 μm thick subbed polyethylene terephthalate support and then dried for 10 minutes at 50° C., producing a silver behenate coverage of approximately 4.35 g/m$^2$.

The emulsion layers were then overcoated with a solution of R01 in aqueous gelatin as described for COMPARATIVE EXAMPLE 1 and INVENTION EXAMPLES 1 & 2.

Thermographic Evaluation

Thermographic evaluation of the recording materials of COMPARATIVE EXAMPLE 3 and INVENTION EXAMPLE 4 was carried out as described for COMPARATIVE EXAMPLE 1 and INVENTION EXAMPLES 1 & 2. The results are summarized in table 8.

TABLE 8

| | | AgBeh coverage [g/m²] | polymer latex number | compound according to formula (I) | Fresh $D_{max}/D_{min}$ (blue) | Archivability $\Delta D_{min}$ (blue) after 3d at 35° C./80% RH | Light box $\Delta D_{min}$ (blue) after 3d at 30° C./85% RH |
|---|---|---|---|---|---|---|---|
| Comparative Example number | 3 | 4.40 | 8 | — | 5.26/0.06 | +0.58 | +0.29 |
| Invention Example number | 4 | 4.24 | 8 | CYMEL ™ 385 | 5.20/0.05 | +0.32 | +0.09 |

The thermographic recording material of INVENTION EXAMPLE 4 with CYMEL™385, a compound according to formula (I), according to the present invention, exhibited much superior archivability [i.e. a lower $\Delta D_{min}$ (blue)] and superior light box stability [i.e. a lower $\Delta D_{min}$ (blue)] to the thermographic recording material of COMPARATIVE EXAMPLE 3, in the absence of a compound according to formula (I).

COMPARATIVE EXAMPLE 4 & INVENTION EXAMPLE 5

Thermosensitive Element Coated From Solvent

A subbed blue pigmented polyethylene terephthalate support having a thickness of 175 μm was coated with a coating composition containing 2-butanone as a solvent and the following ingredients so as to obtain thereon, after drying for 1 hour at 50° C., a layer containing:

| | |
|---|---|
| * AgBeh: | 4.91 g/m² |
| * B79: | 19.62 g/m² |
| * Baysilon ™ MA: | 0.045 g/m² |
| * T01, a toning agent: | 0.268 g/m² |
| * T02, a toning agent: | 0.138 g/m² |
| * R02, a reducing agent: | 0.92 g/m² |
| * S01: | 0.352 g/m² |
| * S02: | 0.157 g/m² |
| * S03: | 0.130 g/m² |

Protective Layer Of COMPARATIVE EXAMPLE 4

An aqueous dispersion was then prepared with the composition given below:

| | |
|---|---|
| * purified polyvinyl alcohol: | 2.5% |
| * Surfactant Nr. 1: | 0.09% |
| * STEAMIC ™ OOS: | 0.05% |
| * SYLOID ™ 72: | 0.10% |
| * SERVOXYL ™ VPDZ 3/100: | 0.09% |
| * SERVOXYL ™ VPAZ 100: | 0.09% |
| * RILANIT ™ GMS: | 0.18% |
| * tetramethyl orthosilicate hydrolyzed in the presence of methanesulfonic acid and alcohol: | 2.1% |
| * ammonium colloidal $SiO_2$: | 1.2% |

Those ingredients which were insoluble in water, were dispersed in a ball mill with, if necessary, the aid of a dispersion agent. Before coating the pH of the composition was adjusted to a pH of 3.8 by adding 1N nitric acid. The thermosensitive element was coated with this dispersion to a wet layer thickness of 85 μm and the layer dried at 40° C. for 15 minutes and then hardened at 45° C. for 7 days, thereby producing the thermographic recording material of COMPARATIVE EXAMPLE 4.

Protective Layer Of INVENTION EXAMPLE 5

An aqueous dispersion was produced by adding the following solutions and dispersions with mixing to 130 g of deionized water: 20 g of a 5% solution of Surfactant Nr. 7, 625 g of a 4.55% solution of purified polyvinyl alcohol, 184.7 g of 0.254% aqueous solution of p-toluenesulfonic acid, 45 g of an aqueous dispersion containing 2.4% of SYLOID™ 72, 2% of SERVOXYL VPDZ 3/100, 2% of SERVOXYL VPAZ 100, 1.2% of MICROACE™ TYPE P3 and 3% of purified polyvinyl alcohol, 32 g of a 5% aqueous dispersion of RILANIT GMS, 60 g of a 15% aqueous dispersion of ammonium colloidal $SiO_2$ and a mixture of 7.2 g of 1N nitric acid and 15 g of deionized water.

The coating dispersion for the protective layer was produced by heating the resulting aqueous dispersion to about 36° C. and adding 6 g of a RESIMENE™ AQ7550 and 50 g of deionized water with stirring just before coating. The thermosensitive element was coated with the protective layer dispersion to a wet layer thickness of 85 μm by doctor blade coating, dried at 40° C. for 15 minutes and then hardened at 45° C. for 7 days, thereby producing the thermographic recording material of INVENTION EXAMPLE 5.

Printing and Evaluation

Printing of the thermographic recording materials of COMPARATIVE EXAMPLE 4 and INVENTION EXAMPLE 5 was then carried out with a commercially available AGFA DRYSTAR™ 2000 (thermal head) printer with a maximum electrical input energy per dot of 63 mW to produce an image over the whole width of the thermal head consisting of 11 blocks each printed at different electrical energies per dot and each with a non-printed strip in the middle thereof 2 mm wide in the printing direction and 18 cm long lateral to the printing direction, while printing the 2 mm wide and 2 cm long strips either side thereof.

The degree to which the print obtained distinguished between these 2 mm wide laterally adjoining non-printed and printed strips was used as a measure of the image quality attained i.e. whether or not the two 2 mm wide and 2 cm long printed strips either side of the 2 mm wide and 18 cm long non-printed strip had been faithfully reproduced. Any non-uniform transport along the thermal head will result in the printed strips either side of the long non-printed strip not being faithfully reproduced with in the case of extremely non-uniform transport none of the 2 mm wide strips being printed i.e. additional thick white lines being observed. The prints were visually evaluated on a scale of 5 to 0 according to the following criteria:

5, very bad clearly visible additional thick white lines either side of each non-printed strip 2 mm wide and 18 cm long 4, bad clearly visible additional white lines at a distance >>20 cm either side of each non-printed strip 2 mm wide and 18 cm long 3, fair additional white lines visible at a viewing distance of 20 cm either side of each non-printed strip 2 mm wide and 18 cm long 2, good additional white lines only visible at a viewing distance <<20 cm either side of each non-printed strip 2 mm wide and 18 cm long 1, very good additional white lines only faintly visible either side of each non-printed strip 2 mm wide and 18 cm long 0, excellent no additional white lines visible Prints with both the thermographic recording materials of COMPARATIVE EXAMPLE 4 and INVENTION EXAMPLE 5 attained an image quality of 1 on this scale and the archivability of these prints assessed after 1 week at 45° C. and ambient relative humidity was very good.

Figure 2:
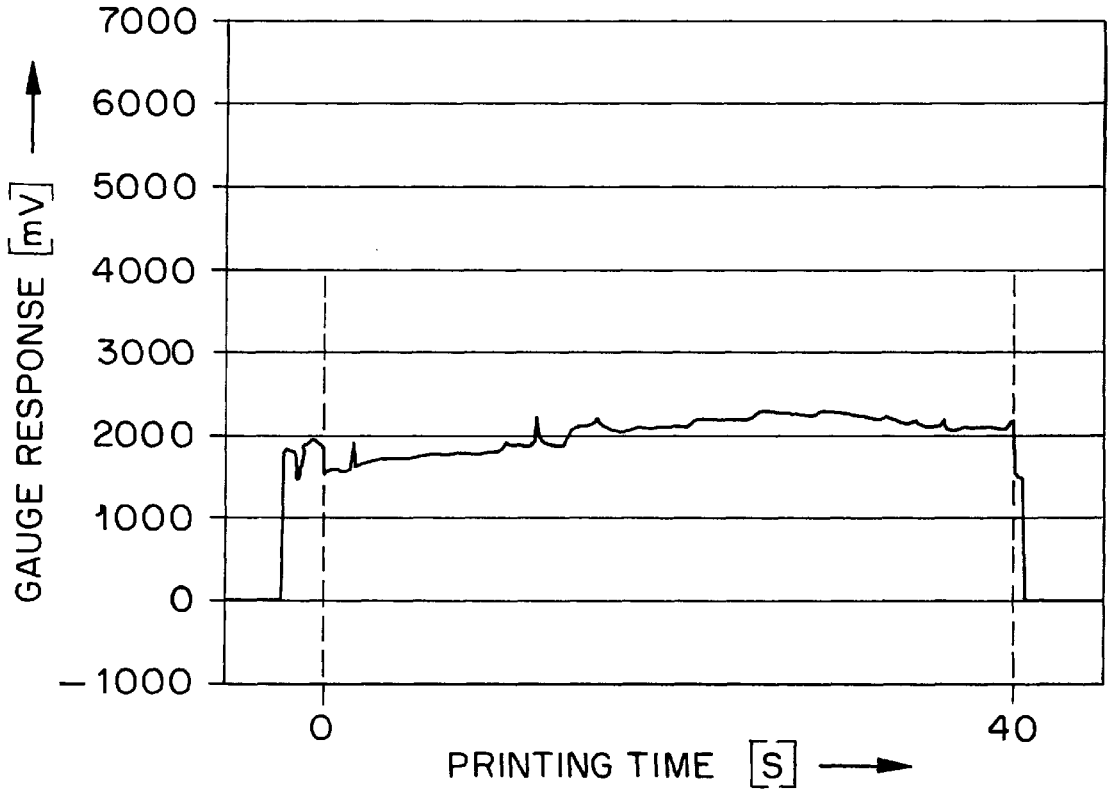
FIG. 2 shows a print-out of strain gauge response in millivolts as a function of printing time in seconds (=position on print with 11 blocks each printed at different electrical energies per dot), as a measure of the dynamical frictional coefficient upon the printing of the thermographic recording material of INVENTION EXAMPLE 5.

The transport performance of the thermographic recording materials of COMPARATIVE EXAMPLE 4 and INVENTION EXAMPLE 5 was further evaluated by modifying an AGFA DRYSTAR™ 2000 (thermal head) printer by incorporating a strain gauge so that the sideways strain generated by the recording materials in contact with the thermal head during the printing process could be determined. The electrical signal generated by the strain gauge coupled to the thermal head at load, L, of 330 g/cm of the thermal head and a transport speed of 4.5 mm/s is a relative measure of the dynamic frictional coefficient. The relative dynamic frictional coefficients were monitored during the printing of an image over the whole width of the thermal head consisting of 11 blocks each printed at different energies per dot and each with a non-printed strip in the middle thereof 2 mm wide in the printing direction and 18 cm long lateral to the printing direction, while printing the 2 mm wide and 2 cm long strips either side thereof. The gauge response as a function of printing time during the printing of the thermographic recording materials of COMPARATIVE EXAMPLE 4 and INVENTION EXAMPLE 5 are shown in FIGS. 1 and 2 respectively. It can be seen that the printing performance of the thermographic recording materials of COMPARATIVE EXAMPLE 4 and INVENTION EXAMPLE 5 are identical within experimental error.

Therefore protective layers coated from an aqueous medium substantially free of solvent and in the absence of water-soluble toxic aldehydes such as formaldehyde using "binders having active hydrogen atoms" and hardeners represented by formula I according to the present invention can achieve the performance of prior art protective layers according to the teaching of WO 95/12495, with the same mix of performance promoting additives, coated from an aqueous medium containing alcohols in which "hydrophilic binders having active hydrogen atoms" are hardened with hydrolyzed tetramethyl orthosilicate. It is therefore possible to avoid the environmentally undesirable emission of alcohols during coating without adversely affecting transport performance during printing.

INVENTION EXAMPLE 6

Thermosensitive Element Coated From An Aqueous Medium

An aqueous dispersion was produced by adding 2.92 g of an aqueous dispersion containing 20% of T01 and 12.5% of GEL01 to 23.69 g of deionized water and then stirring for 60 minutes at 50° C. The coating dispersion for the thermosensitive element was produced by adding with stirring the following dispersions and solutions to the resulting dispersion: 1.11 g of an aqueous dispersion containing 24.3% silver behenate and 2.91% ammonium salt of dodecylphenyl-sulfonate followed by 15 minutes stirring, then 19.1 g of the aqueous dispersion containing 24.3% silver behenate and 2.91% ammonium salt of dodecylphenylsulfonate followed by 15 minutes stirring, then 4.18 g of GEL01 followed by 60 minutes stirring while maintaining a temperature of 50° C., then adjusting the pH to 5.0 with 1N nitric acid and cooling the dispersion to 36° C. and then just before coating 5 g of an aqueous solution containing 20% of R01, 1.7% of boric acid, 3.51% of ammonium tetraborate and 40% of ethanol followed by 1 minute stirring and then 1 g of a aqueous solution containing 19.2% of formaldehyde and 6.75% of methanol.

The coating dispersion was then coated to a wet layer thickness of 56 $\mu$m on a subbed 175 $\mu$m thick polyethylene terephthalate support producing after drying the thermosensitive element of the thermographic recording material of INVENTION EXAMPLE 6 with 4.93 g/m$^2$ of silver behenate and 3.97 g/m$^2$ of gelatin.

Thermographic Recording Material

The thermographic recording material of INVENTION EXAMPLE 6 was produced by coating the thermosensitive element with the protective layer of INVENTION EXAMPLE 5. Printing of the thermographic recording material of INVENTION EXAMPLE 6 was carried out as described for COMPARATIVE EXAMPLE 4 and INVENTION EXAMPLE 5 with similar results.

INVENTION EXAMPLE 7

The thermographic recording material of INVENTION EXAMPLE 7 was produced as described for the thermographic recording material of INVENTION EXAMPLE 6 except that except that the 6 g of RESIMENE™ AQ7550 and 50 g of deionized water were added at the coating station itself. Printing of the thermographic recording material of INVENTION EXAMPLE 7 was carried out as described for COMPARATIVE EXAMPLE 4 and INVENTION EXAMPLE 5 with similar results. This demonstrates that the mode of addition of the compound represented by formula (I) which reacts with purified polyvinyl alcohol, a polymer having active hydrogen atoms, has little influence upon the print quality and the archivability of the prints.

INVENTION EXAMPLE 8

The thermographic recording material of INVENTION EXAMPLE 8 was produced as described for the thermographic recording material of INVENTION EXAMPLE 5 except that the 6 g of RESIMENE™ AQ7550 and 50 g of deionized water were added at the coating station itself. Printing of the thermographic recording material of INVENTION EXAMPLE 8 was carried out as described for COMPARATIVE EXAMPLE 4 and INVENTION EXAMPLE 5 with similar results. These results confirm the results obtained with the thermographic recording material of INVENTION EXAMPLE 7.

INVENTION EXAMPLES 9 to 17

The aqueous dispersions used in the preparation of the protective layers of the thermographic recording materials of INVENTION EXAMPLES 9 to 17 were produced by adding the following solutions and dispersions with mixing to 150 g of deionized water: 20 g of a 5% solution of Surfactant Nr. 7, 575 g of a 5.1% solution of purified polyvinyl alcohol, 204.7 g of 0.230% aqueous solution of p-toluenesulfonic acid, 45 g of an aqueous dispersion containing 2.4% of SYLOID™ 72, 2% of SERVOXYL VPDZ 3/100, 2% of SERVOXYL VPAZ 100, 1.2% of MICROACE™ TYPE P3 and 3% of purified polyvinyl alcohol, 32 g of a 5% aqueous dispersion of RILANIT GMS, 55 g of a 15% dispersion ammonium colloidal $SiO_2$ and a mixture of 1N nitric acid (for quantity see table 9) and 15 g of deionized water.

The coating dispersion for the protective layer was produced by heating the resulting aqueous dispersions to about 36° C. and adding crosslinking agent (for quantity and type used for the particular coating emulsions used in the preparation of the thermographic recording materials of INVENTION EXAMPLES 9 to 17 type see table 9), 50 g of deionized water with stirring just before coating. The thermosensitive element of the thermographic recording material of INVENTION EXAMPLE 6 were coated with the protective layer dispersions to a wet layer thickness of 85 $\mu$m by doctor blade coating, dried at 40° C. for 15 minutes and then hardened at 45° C. for 7 days, thereby producing the thermographic recording materials of INVENTION EXAMPLES 9 to 17.

Printing of the thermographic recording materials of INVENTION EXAMPLES 9 to 17 was carried out as described for COMPARATIVE EXAMPLE 4 and INVENTION EXAMPLE 5 with similar results.

TABLE 9

| Invention example number | quantity of 1N nitric acid [g] | Crosslinking agent type | Crosslinking agent quantity [g] | Image quality | archivability of print |
|---|---|---|---|---|---|
| 9 | 7.2 | RESIMENE AQ-7550 | 4.0 | 1 | very good |
| 10 | 7.2 | RESIMENE AQ-7550 | 6.0 | 1 | very good |
| 11 | 7.2 | RESIMENE AQ-7550 | 8.0 | 1 | very good |
| 12 | 7.2 | RESIMENE AQ-7550 | 10.0 | 1 | very good |
| 13 | 6.0 | MADURITE ™ MW815 | 6.0 | 1 | very good |
| 14 | 5.5 | MAPRENAL ™ VMF3921W | 5.5 | 1 | very good |
| 15 | 7.2 | MAPRENAL ™ MF920 | 6.0 | 1 | very good |
| 16 | 2.0 | CYMEL ™ 373 | 5.5 | 1 | very good |
| 17 | 7.2 | CYMEL ™ 385 | 6.0 | 1 | very good |

The results of the thermographic evaluation of the thermographic recording materials of INVENTION EXAMPLES 9 to 17 summarized in table 9 show that the prints produced with thermographic recording materials containing purified polyvinyl alcohol, a polymer having active hydrogen atoms, with different compounds represented by formula (I) and at different concentrations had no influence upon the print quality and the archivability of the prints.

INVENTION EXAMPLE 18 TO 22

The thermographic recording materials of INVENTION EXAMPLES 18 to 22 correspond to the thermographic recording materials of INVENTION EXAMPLES 13 to 17 respectively differing only in that the thermosensitive element which was coated was that of the thermographic recording material of INVENTION EXAMPLE 5 instead of the thermosensitive element of the thermographic recording material of INVENTION EXAMPLE 6.

Printing of the thermographic recording materials of INVENTION EXAMPLES 18 to 22 was carried out as described for COMPARATIVE EXAMPLE 4 and INVENTION EXAMPLE 5 with similar results. These results confirmed the results obtained with the thermographic recording materials of INVENTION EXAMPLES 13 to 17.

INVENTION EXAMPLE 23

The thermographic recording material of INVENTION EXAMPLE 23 was produced as described for INVENTION EXAMPLE 6 except that LEVASIL™ VP AC 4055 was used instead of a 15% aqueous dispersion of ammonium colloidal $SiO_2$. Printing of the thermographic recording materials of INVENTION EXAMPLE 23 was carried out as described for COMPARATIVE EXAMPLE 4 and INVENTION EXAMPLE 5 with similar results. The replacement of ammonium colloidal silica with colloidal silica with sodium counter-ions in the protective layer of the thermographic recording material containing a reaction product of a compound represented by formula (I) with purified polyvinyl alcohol, a polymer having active hydrogen atoms, had no effect on the print quality and the archivability of the print.

INVENTION EXAMPLE 24

The thermographic recording material of INVENTION EXAMPLE 24 was produced as described for INVENTION EXAMPLE 5 except that LEVASIL™ VP AC 4055 was used instead of a 15% aqueous dispersion of ammonium colloidal $SiO_2$. Printing of the thermographic recording materials of INVENTION EXAMPLE 24 was carried out as described for COMPARATIVE EXAMPLE 4 and INVENTION EXAMPLE 5 with similar results. The results of the thermographic evaluation of the thermographic recording materials of INVENTION EXAMPLES 41 to 46 summarized in table 13 show that the prints produced with thermographic recording materials containing a reaction product of a compound represented by formula (I) with different polymers having active hydrogen atoms in the protective layer have a very good print quality and exhibit very good archivability.

INVENTION EXAMPLES 25 TO 30

The aqueous dispersions used in the preparation of the protective layers of the thermographic recording materials of INVENTION EXAMPLES 25 to 30 were produced by adding the following solutions and dispersions with mixing to 115 g of deionized water: surfactant (for the type, quantity and concentration used, see table 10), 680 g of a 4.55% solution of purified polyvinyl alcohol, 184.7 g of 0.254% aqueous solution of p-toluenesulfonic acid, 45 g of an aqueous dispersion containing 2.4% of SYLOIU™ 72, 2% of SERVOXYL™ VPDZ 3/100, 2% of SERVOXYL™ VPAZ 100, 1.2% of MICROACE™ TYPE P3 and 3% of purified polyvinyl alcohol, 32 g of a 5% aqueous dispersion of RILANIT™ GMS, 60 g of a 15% aqueous dispersion of ammonium colloidal $SiO_2$ and a mixture of 7.2 g of 1N nitric acid and 15 g of deionized water.

The coating dispersions for the protective layers were produced by heating the resulting aqueous dispersions to about 36° C. and adding 6 g of RESIMENE™ AQ-7550 and 50 g of deionized water with stirring just before coating. The pH of the coating dispersions was about 3.7. The thermosensitive element of the thermographic recording material of INVENTION EXAMPLE 6 was coated with the protective layer dispersions to a wet layer thickness of 85 $\mu$m by doctor blade coating, dried at 40° C. for 15 minutes and then hardened at 45° C. for 7 days, thereby producing the thermographic recording materials of INVENTION EXAMPLES 25 to 30.

Printing of the thermographic recording materials of INVENTION EXAMPLES 25 to 30 was carried out as described for COMPARATIVE EXAMPLE 4 and INVENTION EXAMPLE 5 with similar results.

Table 10:

TABLE 10

| Invention example number | Surfactant used Nr | concentration [%] | quantity [g] | Image quality | archivability of print |
|---|---|---|---|---|---|
| 25 | 7 | 5 | 15 | 1 | very good |
| 26 | 7 | 5 | 10 | 1 | very good |
| 27 | 7 | 5 | 5 | 1 | very good |
| 28 | 7* | 5 | 15 | 1 | very good |
| 29 | 8 | 5 | 15 | 1 | very good |
| 30 | 9 | 5 | 15 | 1 | very good |

*passed through an ion-exchange column to remove chloride ions

The results of the thermographic evaluation of the thermographic recording materials of INVENTION EXAMPLES 25 to 30 summarized in table 10 show that the prints produced with thermographic recording materials containing a reaction product of a compound represented by formula (I) with purified polyvinyl alcohol, a polymer having active hydrogen atoms, in the protective layer with different and different quantities of surfactants have a very good print quality and exhibit very good archivability.

INVENTION EXAMPLES 31 TO 35

Protective Layers Of INVENTION EXAMPLES 31 to 35

The aqueous dispersions used in the preparation of the thermographic recording materials of INVENTION EXAMPLES 31 to 35 were produced by adding the following solutions and dispersions with mixing to 150 g of deionized water: 20 g of a 5% aqueous solution of Surfactant Nr. 7, 575 g of a 5.1% solution of purified polyvinyl alcohol, 204.7 g of 0.230% aqueous solution of p-toluenesulfonic acid, a quantity of an aqueous dispersion containing 2.4% of SYLOID™ 72, 2% of SERVOXYL™ VPDZ 3/100, 2% of SERVOXYL™ VPAZ 100, 1.2% of MICROACE™ TYPE P3 and 3% of purified polyvinyl alcohol (for the quantity used, see table 11), a quantity of a 5% aqueous dispersion of RILANIT™ GMS (for the quantity used, see table 11), 55 g of a 15% aqueous dispersion of ammonium colloidal $SiO_2$ and a mixture of 28.8 g of 1N nitric acid and 50 g of deionized water.

The coating dispersions for the protective layer was produced by heating the resulting aqueous dispersions to about 36° C. and adding 24 g of RESIMENE™ AQ-7550 and 240 g of deionized water with stirring just before coating. The pH of the coating dispersion was about 3.9. The thermosensitive element of the thermographic recording material of INVENTION EXAMPLE 6 was coated with the protective layer dispersions to a wet layer thickness of 85 $\mu$m by doctor blade coating, dried at 40° C. for 15 minutes and then hardened at 45° C. for 7 days, thereby producing the thermographic recording materials of INVENTION EXAMPLES 31 to 35.

Printing of the thermographic recording materials of INVENTION EXAMPLES 31 to 35 was carried out as described for COMPARATIVE EXAMPLE 4 and INVENTION EXAMPLE 5 with similar results.

TABLE 11

| Invention example number | quantity of aqueous dispersion containing 2.4% of SYLOID 72, 2% of SERVOXYL VPDZ 3/100, 2% of SERVOXYL VPAZ 100, 1.2% of MICROACE TYPE P3 and 3% of purified polyvinyl alcohol [g] | Quantity of 5% dispersion of RILANIT GMS [g] | Image quality | Archivability of print |
|---|---|---|---|---|
| 31 | 50 | 40 | 1 | very good |
| 32 | 45 | 36 | 1 | very good |
| 33 | 45 | 32 | 1 | very good |
| 34 | 40 | 32 | 1 | very good |
| 35 | 40 | 28 | 1 | very good |

The results of the thermographic evaluation of the thermographic recording materials of INVENTION EXAMPLES 31 to 35 summarized in table 11 show that the prints produced with thermographic recording materials containing a reaction product of a compound represented by formula (I) with purified polyvinyl alcohol, a polymer having active hydrogen atoms, in the protective layer with a wide range of concentrations of a mixture of colloidal silica, talc and phosphate lubricants have a very good print quality and exhibit very good archivability.

INVENTION EXAMPLES 36 & 37

The aqueous dispersions used in the preparation of the protective layers of the thermographic recording materials of INVENTION EXAMPLES 36 & 37 were produced by adding the following solutions and dispersions with mixing to 280 g of deionized water: 60 g of a 5% aqueous solution of Surfactant Nr. 7; 780 g of a 15% solution of MOWIOL™ 3-98; a mixture of 18.8 g of a 10% aqueous solution of p-toluenesulfonic acid, 11 g of 1 N nitric acid and 300 g of deionized water; 180 g of an aqueous dispersion containing 2.4% of SYLOID™ 72, 2% of SERVOXYL VPDZ™ 3/100, 2% of SERVOXYL™ VPAZ 100, 1.2% of MICROACE™ TYPE P3 and 3% of purified polyvinyl alcohol, 128 g of a 5% aqueous dispersion of RILANI™ GMS, 240 g of a 15% aqueous dispersion of ammonium colloidal $SiO_2$ and a mixture of 28.8 g of 1N nitric acid and 50 g of deionized water.

The coating dispersion for the protective layer was produced by heating the resulting aqueous dispersions to about 36° C. and adding 24 g of RESIMENE™ AQ-7550 and 80 g of deionized water with stirring just before coating. The thermosensitive elements of the thermographic recording materials of INVENTION EXAMPLES 5 and 6 were coated with the protective layer dispersions to a wet layer thickness of 40 $\mu$m by doctor blade coating, dried at 40° C. for 15 minutes and then hardened at 45° C. for 7 days, thereby producing the thermographic recording materials of INVENTION EXAMPLES 36 & 37.

Printing of the thermographic recording materials of INVENTION EXAMPLES 36 & 37 was carried out as described for COMPARATIVE EXAMPLE 4 and INVENTION EXAMPLE 5 with similar results. These results show that the prints produced with thermographic recording materials containing a reaction product of a compound represented by formula (I) with a different type pf polyvinyl alcohol, a polymer having active hydrogen atoms, in the protective layer had a very good print quality and exhibit very good archivability.

INVENTION EXAMPLES 38 to 40

The aqueous dispersions used in the preparation of the protective layers of the thermographic recording materials of INVENTION EXAMPLES 38 to 40 were produced by adding the following solutions and dispersions with mixing to 150 g of deionized water: 30 g of a 5% aqueous solution of Surfactant Nr. 7, 400 g of a 5.06% aqueous solution of purified polyvinyl alcohol, 255.5 g of a 0.215% aqueous solution of p-toluenesulfonic acid, 50 g of an aqueous dispersion containing 2.4% of SYLOID™ 72, 2% of SERVOXYL™ VPDZ 3/100, 2% of SERVOXYL™ VPAZ 100, 1.2% of MICROACE™ TYPE P3 and 3% of purified polyvinyl alcohol, 40 g of a 5% aqueous dispersion of RILANIT™ GMS, 70 g of a 15% aqueous dispersion of ammonium colloidal $SiO_2$, 12 g of 1N nitric acid and a quantity of PRIMAL™ HA-16 (for quantity used in the preparation of the protective layer coating dispersion used in the production of the thermographic recording materials of INVENTION EXAMPLES 38 to 40.

The coating dispersion for the protective layers of the thermographic recording materials of INVENTION EXAMPLES 38 to 40 were produced by heating the resulting aqueous dispersions to about 36° C. and adding 7 g of RESIMENE AQ-7550. The thermosensitive element of the thermographic recording materials of INVENTION EXAMPLE 6 was coated with the protective layer dispersions to a wet layer thickness of 85 $\mu$m by doctor blade coating, dried at 40° C. for 15 minutes and then hardened at 45° C. for 7 days, thereby producing the thermographic recording materials of INVENTION EXAMPLES 38 to 40.

Printing of the thermographic recording materials of INVENTION EXAMPLES 38 to 40 was carried out as described for COMPARATIVE EXAMPLE 4 and INVENTION EXAMPLE 5 with similar results.

Table 12:

| Invention example number | quantity of PRIMAL HA 16 [g] | Image quality | archivability of print |
|---|---|---|---|
| 38 | 6.9 | 1 | very good |
| 39 | 12 | 1 | very good |
| 40 | 24 | 1 | very good |

The results of the thermographic evaluation of the thermographic recording materials of INVENTION EXAMPLES 38 to 40 summarized in table 12 show that the prints produced with thermographic recording materials containing a reaction product of a compound represented by formula (I) with purified polyvinyl alcohol, a polymer having active hydrogen atoms, in the protective layer together with a polymer latex in different concentrations have a very good print quality and exhibit very good archivability.

INVENTION EXAMPLES 41 TO 46

The aqueous dispersions used in the preparation of the protective layers of the thermographic recording materials of INVENTION EXAMPLES 41 to 46 were produced by adding the following solutions and dispersions with mixing to 150 g of deionized water: 30 g of a 5% aqueous solution of Surfactant Nr. 7, 550 g of a 5% aqueous solution of binder (for the binder used in the coating dispersions of INVENTION EXAMPLES 41 to 46 see table 13), 5.5 g of a 10% aqueous solution of p-toluenesulfonic acid, 250 g of deionized water, 50 g of an aqueous dispersion containing 2.4% of SYLOID™ 72, 2% of SERVOXYL™ VPDZ 3/100, 2% of SERVOXYL™ VPAZ 100, 1.2% of MICROACE™ TYPE P3 and 3% of purified polyvinyl alcohol, 40 g of a 5% aqueous dispersion of RILANIT™ GMS, 70 g of a 15% aqueous dispersion of ammonium colloidal $Sio_2$ and 15 g of 1N nitric acid.

The coating dispersion for the protective layers of the thermographic recording materials of INVENTION EXAMPLES 41 to 46 were produced by heating the resulting aqueous dispersions to about 36° C. and adding 7 g of RESIMENE™ AQ-7550. The thermosensitive element of the thermographic recording materials of INVENTION Example 6 was coated with the protective layer dispersions to a wet layer thickness of 85 $\mu$m by doctor blade coating, dried at 40° C. for 15 minutes and then hardened at 45° C. for 7 days, thereby producing the thermographic recording materials of invention examples 41 to 46.

Printing of the thermographic recording materials of invention EXAMPLES 41 to 46 was carried out as described for comparative EXAMPLE 4 and invention example 5 with similar results.

Table 13:

| Invention example number | binder | Image quality | archivability of print |
|---|---|---|---|
| 41 | GEL01 | 1 | very good |
| 42 | NATROSOL 250LR | 1 | very good |
| 43 | DEXTRAAN T70 | 1 | very good |
| 44 | CULMINAL M42 | 1 | very good |
| 45 | CYANAMERE P26 | 1 | very good |
| 46 | PVP K-60 | 1 | very good |

The results of the thermographic evaluation of the thermographic recording materials of invention examples 41 to 46 summarized in table 13 show that the prints produced with thermographic recording materials containing a reaction product of a compound represented by formula (I) with different polymers having active hydrogen atoms in the protective layer have a very good print quality and exhibit very good archivability.

Having described in detail preferred embodiments of the current invention it will now be apparent to those skilled in the art that numerous modifications can be made therein without departing from the scope of the invention as defined in the following claims.

What is claimed is:

1. A substantially light-insensitive thermographic recording material comprising a thermosensitive element containing a substantially light-insensitive organic silver salt, a reducing agent therefor in thermal working relationship therewith and a binder, wherein said thermographic recording material contains a compound represented by formula (I) or a reaction product thereof with a polymer having active hydrogen atoms:

(I)

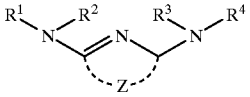

where $R^1$ and $R^3$ independently represent hydrogen, a hydroxyalkyl group, an alkoxyalkyl group, an alkyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; $R^5$ represents an aryl or an alkyl group; and Z represents the atoms needed to complete a 5 ring-atom or 6 ring-atom hetero-aromatic ring; wherein said compound is exclusively present in said thermosensitive element.

2. A substantially light-insensitive thermographic recording material comprising a thermosensitive element containing a substantially light-insensitive organic silver salt, a reducing agent therefor in thermal working relationship therewith and a binder, wherein said thernosensitive element is provided with a protective layer and said protective layer contains the reaction product of a compound represented by formula (I) with a polymer having active hydrogen atoms:

(I)

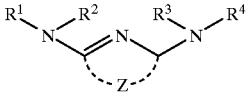

where $R^1$ and $R^3$ independently represent hydrogen, a hydroxyalkyl group, an alkoxyalkyl group, an alkyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; or $R^1$ and $R^2$ together and $R^3$ and $R^4$ together independently represent the atoms needed to close a carbocyclic or heterocyclic ring; $R^5$ represents an aryl or an alkyl group; and Z represents the atoms needed to complete a 5 ring-atom or 6 ring-atom hetero-aromatic ring.

3. A substantially light-insensitive thermographic recording material comprising a thermosensitive element containing a substantially light-sensitive organic silver salt, a reducing agent therefor in thermal working relationship therewith, and a binder, wherein said thermosensitive element is provided with a protective layer, and wherein said thermographic recording material contains a compound represented by formula (I) or a reaction product thereof with a polymer having active hydrogen atoms:

(I)

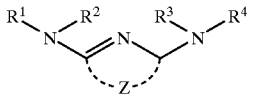

wherein $R^1$ and $R^3$ independently represent hydrogen, a hydroxyalkyl group, an alkoxyalkyl group, an aflyl group, a —(C═O)$R^5$ group or an alkenyl group; and $R^2$ and $R^4$ independently represent a hydroxyalkyl group, and alkoxyallyl group, an alkyl group, a —(C═O)$R^5$ group or an alkeny group; $R^5$ represents an aryl or an alkyl group; and Z represents the atoms needed to complete a 5 ring-atom or 6 ring-atom hetro-aromatic ring, wherein the compound represented by formula (I) or said reaction product thereof is present in said theremosensitive element, and said reaction product is present in said protective layer.

4. Thermographic recording material according to claim 1, 2, or 3, wherein said 5 ring-atom or 6 ring-atom hetero-aromatic ring is substituted with hydrogen, chlorine, fluorine, iodine, bromine or a hydroxy, alkoxy, aryloxy, mercapto, thioalkoxy, —(C═O)$R^6$, aryl, alkyl or —$NR^1R^2$ group, or a linking group between two or more diamino-1, 3,5-triazine groups; and $R^6$ represents hydrogen or an alkyl, aryl, aryloxy, alkoxy, amino or hydroxy group; wherein all these groups may be substituted.

5. Thermographic recording material according to claim 1 or 2 or 3, wherein said compound according to formula (I) is selected from the group of compounds consisting of: melamine compounds, ammeline compounds, melam compounds, guanamine compounds, 2,4-diamino-1,3,5-triazine compounds, 2,4,6-triamino-1,3,5-triazine compounds, 2,6-diaminopyridine compounds, 2,4diamino-pyrimidine compounds, 2,4,6-triamino-pyrimidine compounds, 2,5-diaminopyrrole compounds and 2,5-diamino-oxazole compounds.

6. Thermographic recording material according to claim 1, 2 or 3, wherein said binder is a polymer latex.

7. Thermographic recording material according to claim 1, 2, or 3, wherein said binder is gelatin.

8. Thermographic recording material according to claim 1, 2 or 3, wherein said polymer having active hydrogen atoms contains hydroxy-groups.

9. A photothermographic recording material comprising a photo-addressable thermally developable element containing a substantially light-insensitive organic silver salt, a reducing agent therefor in thermal working relationship therewith, photosensitive silver halide in catalytic association with said substantially light-insensitive organic silver salt and a binder, wherein said photo-addressable thermally developable element is exclusive of a dye-donative material, said photothermographic recording material contains a compound represented by formula (I) or a reaction product thereof with a polymer having active hydrogen atoms:

(I)

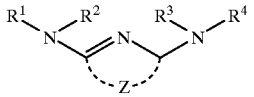

where $R^1$ and $R^3$ independently represent hydrogen, a hydroxyalkyl group, an alkoxyalkyl group, an alkyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; $R^5$ represents an aryl or an alkyl group; and Z represents the atoms needed to complete a 5 ring-atom or 6 ring-atom hetero-aromatic ring; wherein said compound is exclusively present in said photo-addressable thermally developable element.

10. A photothermographic recording material comprising a photo-addressable thermally developable element containing a substantially light-insensitive organic silver salt, a reducing agent therefor in thermal working relationship therewith, photosensitive silver halide in catalytic association with said substantially light-insensitive organic silver salt and a binder, wherein said photo-addressable thermally developable element is exclusive of a dye-donative material, wherein said photo-addressable thermally developable element is provided with a protective layer and said protective layer contains the reaction product of a compound represented by formula (I) with a polymer having active hydrogen atoms:

(I)

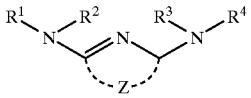

where $R^1$ and $R^3$ independently represent hydrogen, a hydroxyalkyl group, an alkoxyalkyl group, an alkyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; $R^5$ represents an aryl or an alkyl group; and Z represents the atoms needed to complete a 5 ring-atom or 6 ring-atom hetero-aromatic ring.

11. A photothermographic recording material comprising a photo-addressable thermally developable element containing a substantially light-insensitive organic silver salt, a reducing agent therefor in thermal working relationship therewith, photosensitive silver halide in catalytic association with said substantially light-insensitive organic silver salt and a binder, wherein said photo-addressable thermally developable element is provided with a protective layer, and wherein said photoaddressable thermally developable element is exclusive of a dye-donative material, said photothermographic recording material contains a compound represented by formula (I) or a reaction product with a polymer having active hydrogen atoms:

(I)

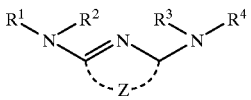

where $R^1$ and $R^3$ independently represent hydrogen, a hydroxyalkyl group, an alkoxyalkyl group, an alkyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; $R^5$ represents an aryl or an alkyl group; and Z represents the atoms needed to complete a 5 ring-atom or 6 ring-atom hetero-aromatic ring, wherein the compound represented by formula (I) or said reaction product thereof is present in said photo-addressable thermally developable element and said reaction product is present in said protective layer.

12. Photothermographic recording material according to claim 9, 10, or 11, wherein said 5 ring-atom or 6 ring-atom hetero-aromatic ring is substituted with hydrogen, chlorine, fluorine, iodine, bromine or a hydroxy, alkoxy, aryloxy, mercapto, thioalkoxy, —(C=O)$R^6$, aryl, alkyl or —$NR^1R^2$ group, or a linking group between two or more diamino-1, 3,5-triazine groups; and $R^6$ represents hydrogen or an alkyl, aryl, aryloxy, alkoxy, amino or hydroxy group; wherein all these groups may be substituted.

13. Photothermographic recording material according to claim 9, 10 or 11, wherein said compound according to formula (I) is selected from the group of compounds consisting of: melamine compounds, ammeline compounds, melam compounds, guanamine compounds, 2,4-diamino-1, 3,5-triazine compounds, 2,4,6-triamino-1,3,5-triazine compounds, 2,6-diaminopyridine compounds, 2,4-diamino-pyrimidine compounds, 2,4,6-triamino-pyrimidine compounds, 2,5-diaminopyrrole compounds and 2,5-diamino-oxazole compounds.

14. Photothermographic recording material according to claim 9, 10, or 11, wherein said binder is a polymer latex.

15. Photothermographic recording material according to claim 9, 10, or 11, wherein said binder is gelatin.

16. Photothermographic recording material according to claim 9, 10 or 11, wherein said polymer having active hydrogen atoms contains hydroxy-groups.

17. Process for producing a thermographic recording material, including a thermosensitive element containing a substantially light-insensitive organic silver salt, a reducing agent therefor in thermal working relationship therewith and a binder comprising the steps of: preparing aqueous dispersions or solutions and together containing said substantially light-insensitive organic silver salt, said organic reducing agent therefor, said binder and a compound represented by formula (I); coating said dispersions or solutions onto a support to form the one or more layers making up said thermosensitive element, wherein said thermographic recording material contains a compound represented by formula (I) or a reaction product thereof with a polymer having active hydrogen atoms:

(I)

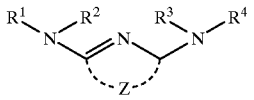

where $R^1$ and $R^3$ independently represent hydrogen, a hydroxyalkyl group, an alkoxyalkyl group, an alkyl group, a —(C=O)$R^5$ group or an alkenyl group; and $R^2$ and $R^4$ independently represent a hydroxyalkyl group, an alkoxy-alkyl group, an alkyl group, a —(C=O)$R^5$ group or an alkenyl group; $R^5$ represents an aryl or an alkyl group; and Z represents the atoms needed to complete a 5 ring-atom or 6 ring-atom hetero-aromatic ring; wherein said compound is exclusively present in said thermosensitive element.

18. Process for producing a thermographic recording material, including a thermosensitive element containing a substantially light-insensitive organic silver salt, a reducing agent therefor in thermal working relationship therewith and a binder comprising the steps of: preparing aqueous dispersions or solutions and together containing said substantially light-insensitive organic silver salt, said organic reducing agent therefor, said binder and a compound represented by formula (I); coating said dispersions or solutions onto a support to form the one or more layers making up said thermosensitive element, wherein said thermosensitive element is provided with a protective layer and said protective layer contains the reaction product of a compound presented by formula (I) with a polymer having active hydrogen atoms:

(I)

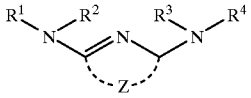

where $R^1$ and $R^3$ independently represent hydrogen, a hydroxyalkyl group, an alkoxyalkyl group, an alkyl group, a —(C=O)$R^5$ group or an alkenyl group; and $R^2$ and $R^4$ independently represent a hydroxyalkyl group, an alkoxy-alkyl group, an alkyl group, a —(C=O)$R^5$ group or an alkenyl group; $R^5$ represents an aryl or an alkyl group; and Z represents the atoms needed to complete a 5 ring-atom or 6 ring-atom hetero-aromatic ring.

19. Process for producing a thermographic recording material, including a thermosensitive element containing a substantially light-insensitive organic silver salt, a reducing agent therefor in thermal working relationship therewith and a binder, wherein said thermosensitive element is provided with a protective layer, comprising the steps of: preparing aqueous diersions or solutions and together containing said substantially light-insensitive organic silver salt, said organic reducing agent therefor, said binder and a compound represented by formula (I); coating said dispersions or solutions onto a support to form the one or more layers making up said thermosensitive element, wherein said thermographic recording material contains a compound represented by formula (I) or a reaction product thereof with a polymer having active hydrogen atoms:

(I)

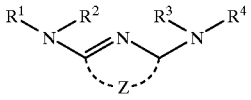

where $R^1$ and $R^3$ independently represent hydrogen a hydoxyalkyl group, an alkoxyalkal group, an alkyl group, a —(C=O)$R^5$ group or an alkenyl group; and $R^2$ and $R^4$ independently represent a hydroxyalkyl group, an alkoxy-alklyl group, an alkyl group, a —(C=O)$R^5$ group or an alkenyl group; $R^5$ represents an aryl or an alkyl group; and Z represents the atoms needed to complete a 5 ring-atom or 6 ring-atom hetero-aromatic ring wherein the compound represented by formula (I) or said reaction product thereof is present in said protective layer.

20. The process of claim 17, 18, or 19, wherein said 5 ring-atom or 6 ring-atom hetero-aromatic ring is substituted with hydrogen, chlorine, fluorine, iodine, bromine or a hydroxy, alkoxy, aryloxy, mercapto, thioalkoxy, —(C=O)$R^6$, aryl, alkyl or —$NR^1R^2$ group, or a linking group between two or more diamino-1,3,5-triazine groups; and $R^6$ represents hydrogen or an alkyl, aryl, aryloxy, alkoxy, amino or hydroxy group; wherein all these groups may be substituted.

21. The process according to claim 17, 18 or 19, wherein said compound according to formula (I) is selected from the group of compounds consisting of: melamine compounds, ammeline compounds, melam compounds, guanamine compounds, 2,4-diamino-1,3,5-triazine compounds, 2,4,6-triamino-1,3,5-triazine compounds, 2,6-diaminopyridine compounds, 2,4-diamino-pyrimidine compounds, 2,4,6-triamino-pyrimidine compounds, 2,5-diaminopyrrole compounds and 2,5-diamino-oxazole compounds.

22. Process for producing a photothermographic recording material, including a photo-addressable thermally developable element containing a substantially light-insensitive organic silver salt, a reducing agent therefor in thermal working relationship therewith, photosensitive silver halide in catalytic association with said substantially light-insensitive organic silver salt and a binder, comprising the steps of: preparing aqueous dispersions or solutions together containing said substantially light-insensitive organic silver salt, said organic reducing agent therefor, said photosensitive silver halide, said binder and a compound represented by formula (I); coating said dispersions or solutions onto a support to form the one or more layers making up the photo-addressable thermally developable element, wherein said photo-addressable thermally developable element is exclusive of a dye-donative material, said photothermographic recording material contains a compound represented by formula (I) or a reaction product thereof with a polymer having active hydrogen atoms:

(I)

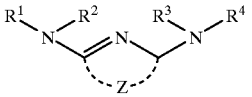

where $R^1$ and $R^3$ independently represent hydrogen, a hydroxyalkyl group, an alkoxyalkyl group, an alkyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; $R^5$ represents an aryl or an alkyl group; and Z represents the atoms needed to complete a 5 ring-atom or 6 ring-atom hetero-aromatic ring; wherein said compound is exclusively present in said thermosensitive element.

23. Process for producing a photothermographic recording material, including a photo-addressable thermally developable element containing a substantially light-insensitive organic silver salt, a reducing agent therefor in thermal working relationship therewith, photosensitive silver halide in catalytic association with said substantially light-insensitive organic silver salt and a binder, comprising the steps of: preparing aqueous dispersions or solutions together containing said substantially light-insensitive organic silver salt, said organic reducing agent therefor, said photosensitive silver halide, said binder and a compound represented by formula (I); coating said dispersions or solutions onto a support to form the one or more layers making up the photo-addressable thermally developable element, wherein said photo-addressable thermally developable element is exclusive of a dye-donative material, wherein said photo-addressable thermally developable element is provided with a protective layer and said protective layer contains the reaction product of a compound represented by formula (I) with a polymer having active hydrogen atoms:

(I)

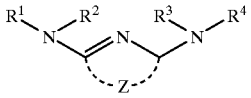

where $R^1$ and $R^3$ independently represent hydrogen, a hydroxyalkyl group, an alkoxyalkyl group, an alkyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; $R^1$ represents an aryl or an alkyl group; and Z represents the atoms needed to complete a 5 ring-atom or 6 ring-atom hetero-aromatic ring.

24. Process for producing a photothermographic recording material, including a photo-addressable thermally developable element containing a substantially light-insensitive organic silver salt, a reducing agent therefor in thermal working relationship therewith, photosensitive silver halide in catalytic association with said substantially light-insensitive organic silver salt and a binder, wherein said photo-addressable thermally developable element is provided with a protective layer, comprising the steps of preparing aqueous dispersions or solutions together containing said substantially light-insensitive organic silver salt, said organic reducing agent therefor, said photosensitive silver halide, said binder and a compound represented by formula (I); coating said dispersions or solutions onto a support to form the one or more layers making up the photo-addressable thermally developable element, wherein said photo-addressable thermally developable element is exclusive of a dye-donative material, said photo-thermographic recording material contains a compound represented by formula (I) or a reaction product thereof with a polymer having active hydrogen atoms:

(I)

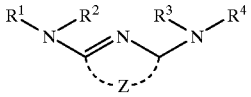

wherein $R^1$ and $R^3$ independently represent hydrogen, a hydroxyalkyl group, an alkoxyallyl group, an allyl group, a —(C═O)$R^5$ group or an alkenyl group; and $R^2$ and $R^4$ independently represent a hydroxyalkyl group, an alkoxyalkyl group, an alkyl group, a —(C═O)$R^5$ group or an alkenyl group; $R^5$ represents an aryl or an alkyl group; and Z represents the atoms needed to complete a 5 ring-atom or 6 ring-atom hetero-aromatic ring wherein the compound represented by formula (I) or said reaction product thereof is present in said photo-addressable thermally developable element, and said reaction product is present in said protective layer.

25. The process of claim 18, 22, 23, or 24, wherein said 5 ring-atom or 6 ring-atom hetero-aromatic ring is substituted with hydrogen, chlorine, fluorine, iodine, bromine or a hydroxy, alkoxy, aryloxy, mercapto, thioalkoxy, —(C═O)

$R^6$, aryl, alkyl or —$NR^1R^2$ group, or a linking group between two or more diamino-1,3,5-triazine groups; and $R^6$ represents hydrogen or an alkyl, aryl, aryloxy, alkoxy, amino or hydroxy group; wherein all these groups may be substituted.

26. The process according to claim 18, 22, 23, or 24, wherein said compound according to formula (I) is selected from the group of compounds consisting of: melamine compounds, ammeline compounds, melam compounds, guanamine compounds, 2,4-diamino-1,3,5-triazine compounds, 2,4,6-triamino-1,3,5-triazine compounds, 2,6-diaminopyridine compounds, 2,4diamino-pyrimidine compounds, 2,4, 6-triamino-pyrimidine compounds, 2,5-diaminopyrrole compounds and 2,5-diamino-oxazole compounds.

* * * * *

UNITED STATES PATENT AND TRADEMARK OFFICE

CERTIFICATE OF CORRECTION

PATENT NO. : 6,063,559
DATED : May 16, 2000
INVENTOR(S) : Uyttendaele et al.

It is certified that error appears in the above-identified patent and that said Letters Patent is hereby corrected as shown below:

Column 34,
Line 60, "light sensitive" should read -- light insensitive --;

Column 40,
Line 63, "claim 18, 22, 23, or 24, should read -- claim 22, 23 or 24 --;

Column 41,
Line 6, "claim 18, 22, 23, or 24," should read -- claim 22, 23, or 24 -- .

Signed and Sealed this

Twelfth Day of February, 2002

*Attest:*

*Attesting Officer*

JAMES E. ROGAN
*Director of the United States Patent and Trademark Office*